US010069229B2

(12) United States Patent
Muro

(10) Patent No.: US 10,069,229 B2
(45) Date of Patent: Sep. 4, 2018

(54) ELECTRIC CONNECTOR

(71) Applicant: DAI-ICHI SEIKO CO., LTD., Kyoto-shi (JP)

(72) Inventor: Masataka Muro, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 15/802,745

(22) Filed: Nov. 3, 2017

(65) Prior Publication Data

US 2018/0166813 A1 Jun. 14, 2018

(30) Foreign Application Priority Data

Dec. 9, 2016 (JP) ..... 2016-239576

(51) Int. Cl.
*H01R 12/77* (2011.01)
*H01R 12/59* (2011.01)
(Continued)

(52) U.S. Cl.
CPC ..... *H01R 12/774* (2013.01); *H01R 12/592* (2013.01); *H01R 12/61* (2013.01);
(Continued)

(58) Field of Classification Search
CPC ..... H01R 12/79; H01R 12/77; H01R 12/771; H01R 12/772; H01R 12/774; H01R 12/61; H01R 12/62
(Continued)

(56) References Cited

U.S. PATENT DOCUMENTS 6,679,713 B2 * 1/2004 Miura ..... H01R 12/79 439/260
7,134,891 B2 * 11/2006 Kayama ..... H01R 12/88 439/260
(Continued)

FOREIGN PATENT DOCUMENTS

CN 202183523 U 4/2012
CN 102842798 A 12/2012
(Continued)

OTHER PUBLICATIONS

European Office Action dated Apr. 18, 2018 in European Application No. 17204779.7, 8 pages.
(Continued)

*Primary Examiner* — Ross Gushi
(74) *Attorney, Agent, or Firm* — Oblon, McClelland, Maier & Neustadt, L.L.P.

(57) ABSTRACT

For easy removal of a flat-plate-shaped signal transmission medium while reduction in height and size is achieved with a simple structure, a structure is adopted for an electric connector as follows. That is, a release operating part of a lock releasing member which causes a lock member in an engaged state to make a transition to a released state is arranged along an insertion opening. The release operating part and a release acting part are arranged in opposite regions in a radius direction of rotation of a support shaft part. The release operating part can make reciprocating rotations between an initial position away from the insertion opening and an acting position close to the insertion opening. Thus, when a flat-plate-shaped signal transmission medium is removed, the flat-plate-shaped signal transmission medium can be held while the engaged state of the lock member with respect to the flat-plate-shaped signal transmission medium is released by one hand of an operator.

4 Claims, 27 Drawing Sheets

(51) Int. Cl.

| | |
|---|---|
| ***H01R 13/641*** | (2006.01) |
| ***H01R 13/639*** | (2006.01) |
| ***H01R 12/61*** | (2011.01) |
| ***H01R 12/72*** | (2011.01) |
| *H01R 12/87* | (2011.01) |
| *H01R 12/79* | (2011.01) |

(52) U.S. Cl.
CPC ..... *H01R 12/727* (2013.01); *H01R 13/639* (2013.01); *H01R 13/641* (2013.01); *H01R 12/79* (2013.01); *H01R 12/87* (2013.01)

(58) Field of Classification Search
USPC ..... 439/495
See application file for complete search history.

(56) References Cited

U.S. PATENT DOCUMENTS 7,591,661 B2 * 9/2009 Suzuki ..... H01R 12/79 439/260
7,766,680 B2 * 8/2010 Suzuki ..... H01R 12/88 439/260
7,850,473 B1 * 12/2010 Ozeki ..... H01R 23/661 439/260
8,002,567 B2 * 8/2011 Hara ..... H01R 12/89 439/329
8,337,230 B1 * 12/2012 Kurachi ..... H01R 12/79 439/328
8,398,417 B2 * 3/2013 Ozeki ..... H01R 12/774 439/260
8,662,915 B2 * 3/2014 Ueda ..... H01R 12/79 439/260
8,678,844 B2 * 3/2014 Yoshisuji ..... H01R 12/592 439/260
8,808,020 B2 * 8/2014 Ikari ..... H01R 12/7029 439/153
8,851,918 B2 * 10/2014 Yoshisuji ..... H01R 13/639 439/260
8,939,790 B2 * 1/2015 Jung ..... H01R 12/774 439/495
8,968,020 B2 * 3/2015 Nishiyama ..... H01R 13/627 439/345
9,054,451 B2 * 6/2015 Tateishi ..... H01R 12/774
9,065,210 B2 * 6/2015 Narita ..... H01R 13/629
9,099,822 B2 * 8/2015 Miki ..... H01R 12/79
9,153,888 B2 * 10/2015 Kajiura ..... H01R 12/72
9,356,373 B2 * 5/2016 Komoto ..... H01R 12/772
9,401,554 B2 * 7/2016 Takane ..... H01R 12/771
9,455,513 B2 * 9/2016 Yokoo ..... H01R 12/88
9,455,531 B2 * 9/2016 Qian ..... H01R 12/772
9,490,559 B2 * 11/2016 Takane ..... H01R 12/774
2007/0077809 A1 * 4/2007 Takashita ..... H01R 13/629 439/492
2007/0202737 A1 * 8/2007 Wei ..... H01R 12/79 439/495
2008/0254662 A1 * 10/2008 Koga ..... H01R 12/79 439/260
2008/0305677 A1 * 12/2008 Koga ..... H01R 12/79 439/492
2009/0023324 A1 * 1/2009 Koike ..... H01R 12/79 439/345
2010/0261375 A1 * 10/2010 Wang ..... H01R 12/88 439/492
2011/0092091 A1 * 4/2011 Ogura ..... H01R 12/79 439/345
2011/0136365 A1 * 6/2011 Hara ..... H01R 12/79 439/329
2011/0244709 A1 * 10/2011 Ashibu ..... H01R 12/774 439/372
2012/0045930 A1 * 2/2012 Ueda ..... H01R 12/79 439/497
2012/0064749 A1 * 3/2012 Hashimoto ..... H01R 12/774 439/329
2012/0100742 A1 * 4/2012 Ishimaru ..... H01R 12/61 439/345
2012/0164882 A1 * 6/2012 Ozeki ..... H01R 12/772 439/607.46
2012/0220171 A1 * 8/2012 Shimada ..... H01R 12/774 439/660
2012/0238125 A1 * 9/2012 Yoshisuji ..... H01R 12/592 439/350
2012/0258618 A1 * 10/2012 Sasaki ..... H01R 12/78 439/260
2012/0289093 A1 * 11/2012 Ogura ..... H01R 12/88 439/629
2012/0322293 A1 * 12/2012 Shimada ..... H01R 12/79 439/350
2012/0329300 A1 * 12/2012 Ikari ..... H01R 12/7029 439/153
2013/0023138 A1 * 1/2013 Sasaki ..... H01R 12/88 439/260
2013/0023142 A1 * 1/2013 Sasaki ..... H01R 12/592 439/325
2013/0065417 A1 * 3/2013 Kurachi ..... H01R 12/772 439/325
2013/0095675 A1 * 4/2013 Wang ..... H01R 12/774 439/62
2013/0196529 A1 * 8/2013 Jung ..... H01R 12/774 439/345
2013/0231002 A1 * 9/2013 Yokoo ..... H01R 12/772 439/372
2013/0309887 A1 * 11/2013 Honda ..... H01R 13/193 439/260
2013/0309891 A1 * 11/2013 Tateishi ..... H01R 12/774 439/310
2014/0045383 A1 * 2/2014 Fujii ..... H01R 12/79 439/630
2014/0057478 A1 * 2/2014 Yoshisuji ..... H01R 13/639 439/350
2014/0073166 A1 * 3/2014 Kim ..... H01R 12/772 439/345
2014/0349526 A1 * 11/2014 Takane ..... H01R 12/79 439/733.1
2015/0118909 A1 * 4/2015 Yokoo ..... H01R 12/775 439/607.55
2015/0171536 A1 * 6/2015 Kameda ..... H01R 12/772 439/329
2015/0244092 A1 * 8/2015 Ashibu ..... H01R 12/774 439/372
2015/0270632 A1 * 9/2015 Takane ..... H01R 12/716 439/78
2016/0126649 A1 * 5/2016 Takane ..... H01R 12/771 439/660
2016/0134043 A1 * 5/2016 Takane ..... H01R 12/774 439/660
2016/0141785 A1 * 5/2016 Yokoo ..... H01R 12/88 439/733.1
2016/0268717 A1 * 9/2016 Tamaki ..... H01R 12/721
2017/0133774 A1 * 5/2017 Tateishi ..... H01R 12/616
2017/0141513 A1 * 5/2017 Hashiguchi ..... H01R 13/639
2017/0250483 A1 * 8/2017 Ishishita ..... H01R 12/774
2017/0331206 A1 * 11/2017 Manba ..... H01R 12/61
2017/0331211 A1 * 11/2017 Nakajima ..... H01R 12/88

FOREIGN PATENT DOCUMENTS

| | | | |
|---|---|---|---|
| CN | 102842798 | B | 11/2014 |
| CN | 102842811 | B | 12/2014 |
| EP | 2487759 | A2 | 8/2012 |
| JP | 2009-238425 | | 10/2009 |
| JP | 2010-73321 | | 4/2010 |
| JP | 2011-040295 | A | 2/2011 |
| JP | 2013-45541 | | 3/2013 |
| JP | 2013-110001 | | 6/2013 |
| JP | 2013-178892 | | 9/2013 |
| TW | 201101614 | A1 | 1/2011 |
| TW | 201223016 | A1 | 6/2012 |
| WO | 2012/008353 | A1 | 1/2012 |

(56) References Cited

FOREIGN PATENT DOCUMENTS

OTHER PUBLICATIONS

Office Action dated Jul. 10, 2018. in Taiwanese Patent Application No. 106132110. citing documents AO, AP, AQ, and AR.

* cited by examiner

ELECTRIC CONNECTOR

TECHNICAL FIELD OF THE INVENTION

The present invention relates to an electric connector configured to use a lock member to hold a flat-plate-shaped signal transmission medium inserted inside a housing.

BACKGROUND OF THE INVENTION

Conventionally, in various electrical appliances and so forth, electric connectors have been widely used for electrically connecting a flat-plate-shaped signal transmission medium such as a flexible flat cable (FFC) or a flexible printed circuit (FPC) to a circuit wiring board. An electric connector of this type is used with a connection terminal part of a conductive contact member being mounted by, for example, solder joint or the like, on a main surface of the circuit wiring board. The flat-plate-shaped signal transmission medium inserted into an insertion opening provided to a housing of the electric connector is electrically connected to the circuit wiring board as being retained in contact with the conductive contact member attached to the housing.

To retain the flat-plate-shaped signal transmission medium inserted inside the electric connector as described above, a positioning part formed of, for example, a notched concave part, is formed on a terminal portion on a depth side in an inserting direction in the flat-plate-shaped signal transmission medium. In a widely-adopted structure, with part of a lock member provided to the electric connector being engaged with that positioning part, the flat-plate-shaped signal transmission medium is retained. When the flat-plate-shaped signal transmission medium engaged by the lock member is released, while operation is performed such as, for example, pushing a lock releasing part in a predetermined direction by one hand of an operator, the flat-plate-shaped signal transmission medium is held by the other hand to be extracted outside the electric connector.

Therefore, when the flat-plate-shaped signal transmission medium retained as being engaged inside the electric connector is removed, both hands of the operator have to be used to perform operation of releasing the lock member. In particular, as described in Japanese Unexamined Patent Application Publication No. 2013-178892 mentioned below, if lock members are arranged at both end portions in a connector longitudinal direction, for example, when the flat-plate-shaped signal transmission medium is removed from the electric connector in a narrow space inside an electrical appliance or the like, it is difficult to perform the operation by both hands in that narrow space. Also, in the first place, both hands may not be able to enter the inside of the narrow space, thereby disabling the removal operation itself.

The inventor of the present application discloses Japanese Unexamined Patent Application Publication No. 2013-178892 as a prior art document of the present invention.

Thus, an object of the present invention is to provide an electric connector having a simple structure and allowing easy removal of a flat-plate-shaped signal transmission medium inserted inside a housing.

SUMMARY OF THE INVENTION

To achieve the above object, in an electric connector according to the present invention configured as follows, a terminal portion of a flat-plate-shaped signal transmission medium is inserted inside a housing through an insertion opening provided to an insulating housing to be mounted on a circuit wiring board as extending in a narrow elongated shape, with an engaging part of a lock member being in an engaged state with respect to the flat-plate-shaped signal transmission medium inserted inside the housing, the flat-plate-shaped signal transmission medium is retained by the lock member, and also a conductive contact member attached to the housing is electrically connected to the flat-plate-shaped signal transmission medium, and by rotating, from an initial position to an acting position, a release operating part of a lock releasing member attached to the housing as being in a state of making reciprocating rotations about a support shaft part extending along an extending direction of the insertion opening, a release acting part of the lock releasing member which operates in an interlocked manner with the rotation of the release operating part is caused to make contact with the lock member to cause an engaging part of the lock member in the engaged state to make a transition to a released state.

In the above-described electric connector, a structure is adopted as follows. That is, the release operating part provided to the lock release member is arranged as extending along the extending direction of the insertion opening, the release operating part and the release acting part of the lock releasing member are arranged so as to be opposed to each other across the support shaft part in a radius direction of rotation about the support shaft part, and the release operating part of the lock releasing member is positioned away from the insertion opening at the initial position and is positioned close to the insertion opening at the acting position.

According to this structure, when the flat-plate-shaped signal transmission medium inserted inside the insertion opening of the housing to be in an engaged state is removed, for example, when the release operating part of the lock releasing member is rotated by a finger tip of the operator to the acting position, the release operating part of the lock releasing member is positioned to be close to the insertion opening and thus is moved so as to be in a state of being close to the flat-plate-shaped signal transmission medium inserted in the insertion opening. As a result, for example, the finger tip of the operator pressed onto the release operating part of the lock releasing member becomes in a state capable of making contact also with the flat-plate-shaped signal transmission medium. For example, while the engaged state of the lock member with respect to the flat-plate-shaped signal transmission medium is released by the finger tip of one hand of the operator, the flat-plate-shaped signal transmission medium can be held. This allows removal of the flat-plate-shaped signal transmission medium only by one hand.

Also, the lock member in the present invention can be arranged on each of both side portions of the insertion opening to form a pair in the extending direction of the insertion opening.

Furthermore, the lock releasing member in the present invention is desirably provided with a positioning part which makes contact with a wall part of the housing when the release operating part is rotated to the acting position.

According to this structure, excessive rotating operation of the lock releasing member is regulated by the wall part of the housing, thereby avoiding plastic deformation of the lock member and preventing damages on each part configuring the connector.

Furthermore, in the present invention, a structure can be achieved in which, when the release operating part of the lock releasing member is rotated from the initial position to the acting position, the release acting part is positioned away from the insertion opening.

As described above, in the electric connector according to the present invention, a structure is adopted as follows. That is, the release operating part of the lock releasing member which causes the lock member in an engaged state to make a transition to a released state is arranged as extending along the extending direction of the insertion opening. The release operating part and the release acting part of the lock releasing member are arranged so as to be opposed to each other across the support shaft part. The release operating part of the lock releasing member can make reciprocating rotations between the initial position away from the insertion opening and the acting position close to the insertion opening. Thus, when the flat-plate-shaped signal transmission medium is removed, for example, when the release operating part of the lock releasing member is rotated by the finger tip of the operator to the acting position, the release operating part of the lock releasing member moves so as to be in a state of being close to the flat-plate-shaped signal transmission medium. Thus, the flat-plate-shaped signal transmission medium can be held while the engaged state of the lock member with respect to the flat-plate-shaped signal transmission medium is released by one hand of the operator. This allows easy removal of the flat-plate-shaped signal transmission medium with a simple structure.

BRIEF DESCRIPTIONS OF THE DRAWINGS

DESCRIPTIONS OF THE PREFERRED EMBODIMENTS

Figure 1:
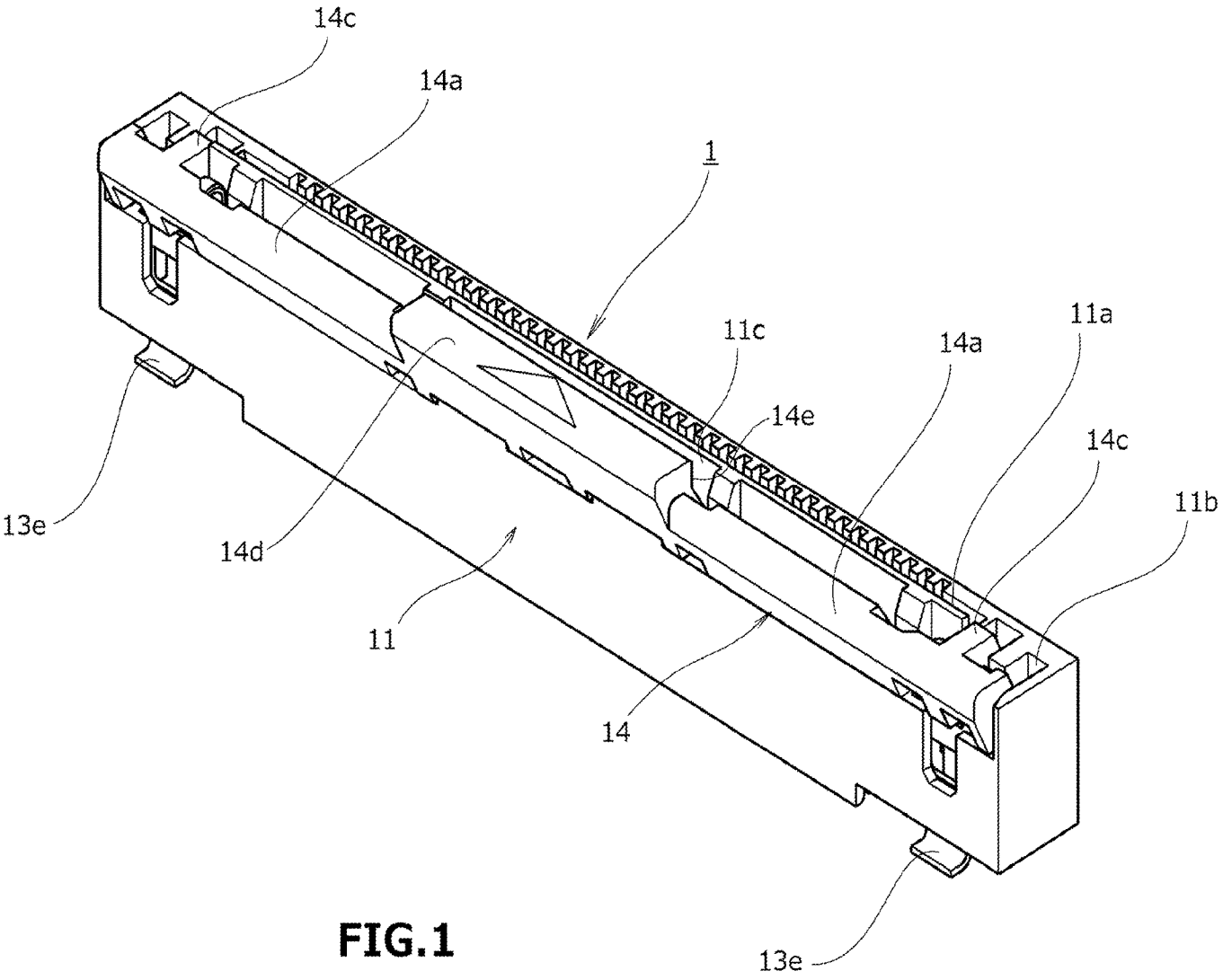
FIG. 1 is an external perspective view of an electric connector according to one embodiment of the present invention in an initial state when viewed from above and front.
Figure 2:
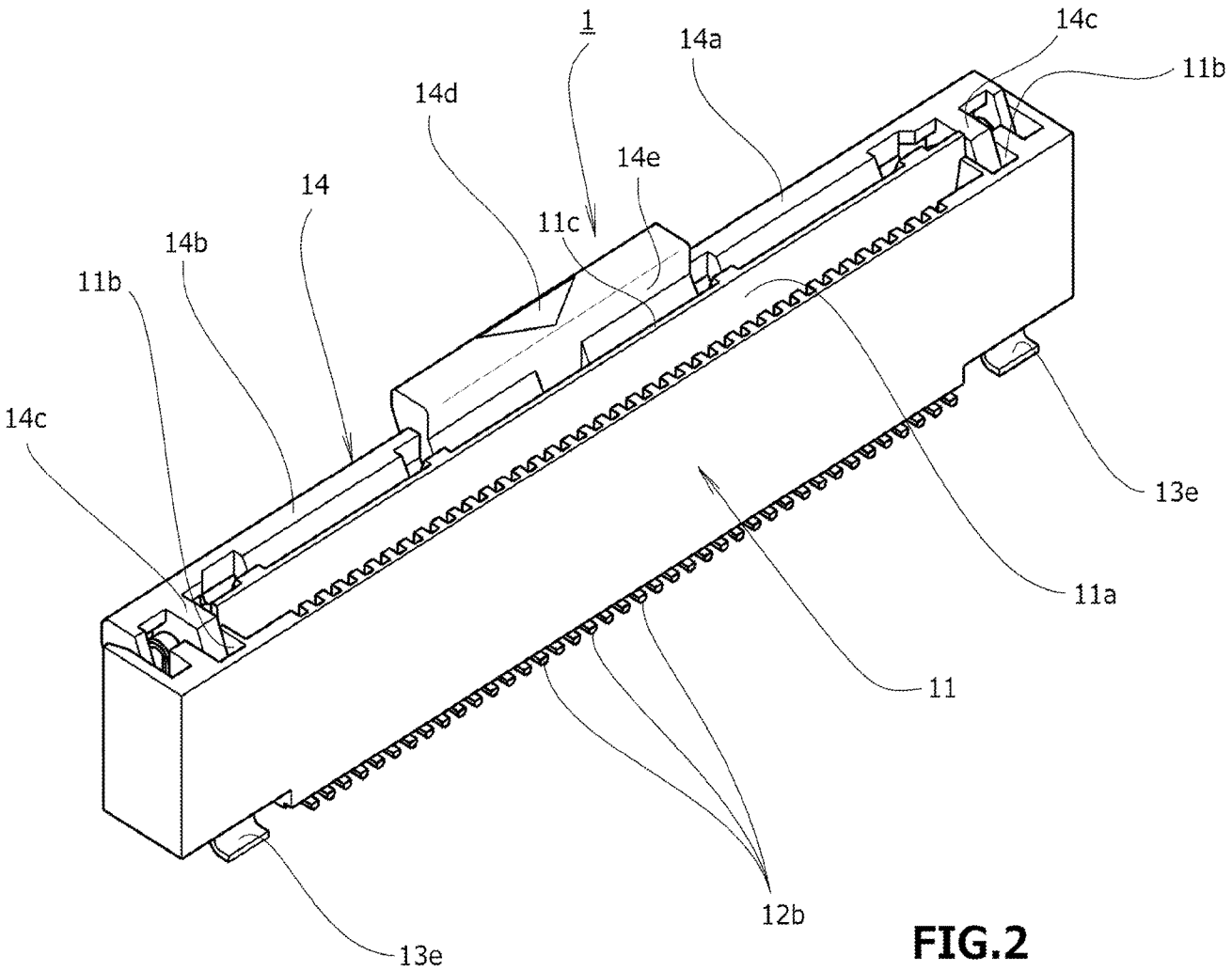
FIG. 2 is an external perspective view of the electric connector depicted in FIG. 1 when viewed from above and back.
Figure 3:
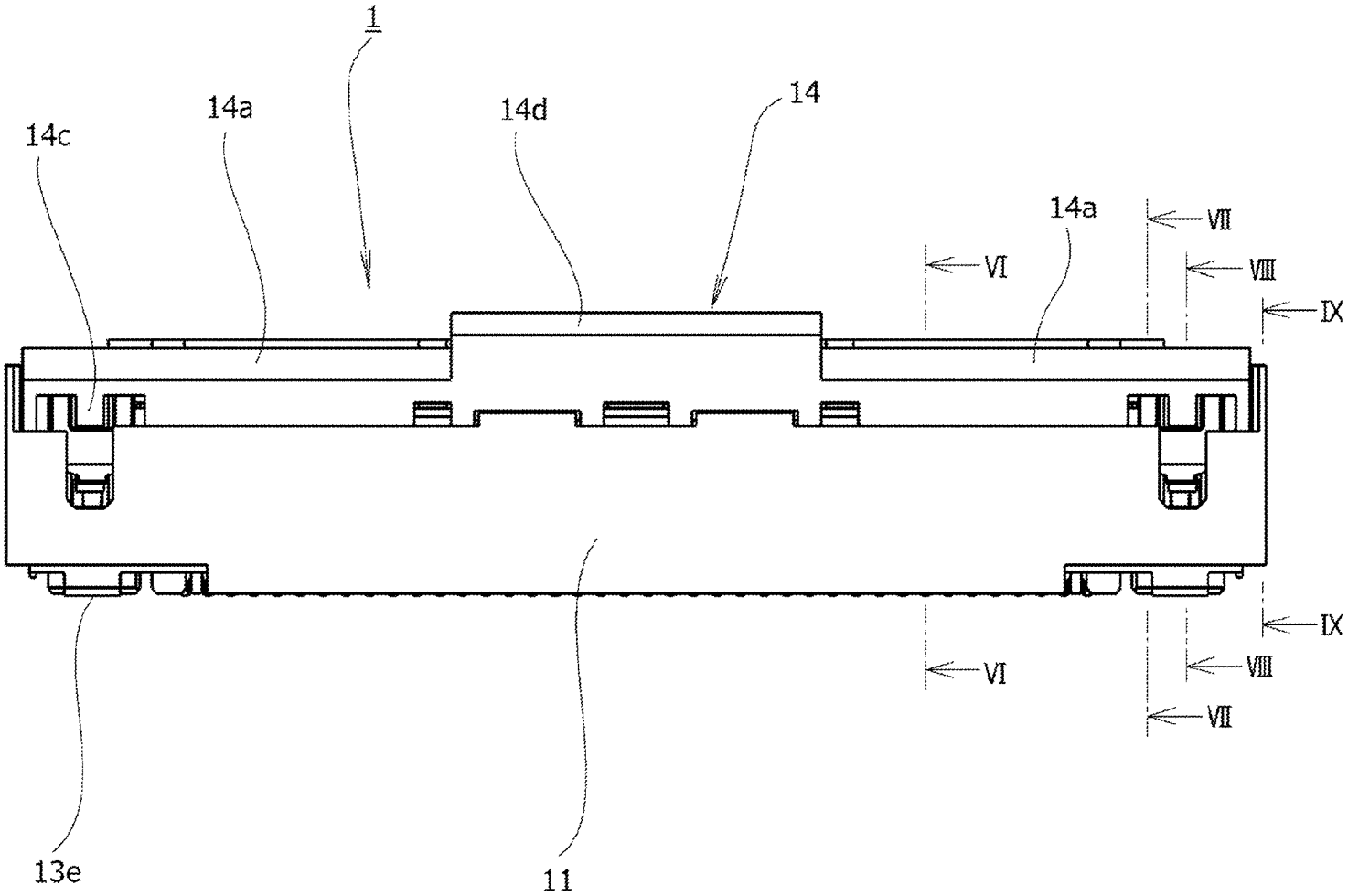
FIG. 3 is a front view of the electric connector depicted in FIG. 1 and FIG. 2.
Figure 4:
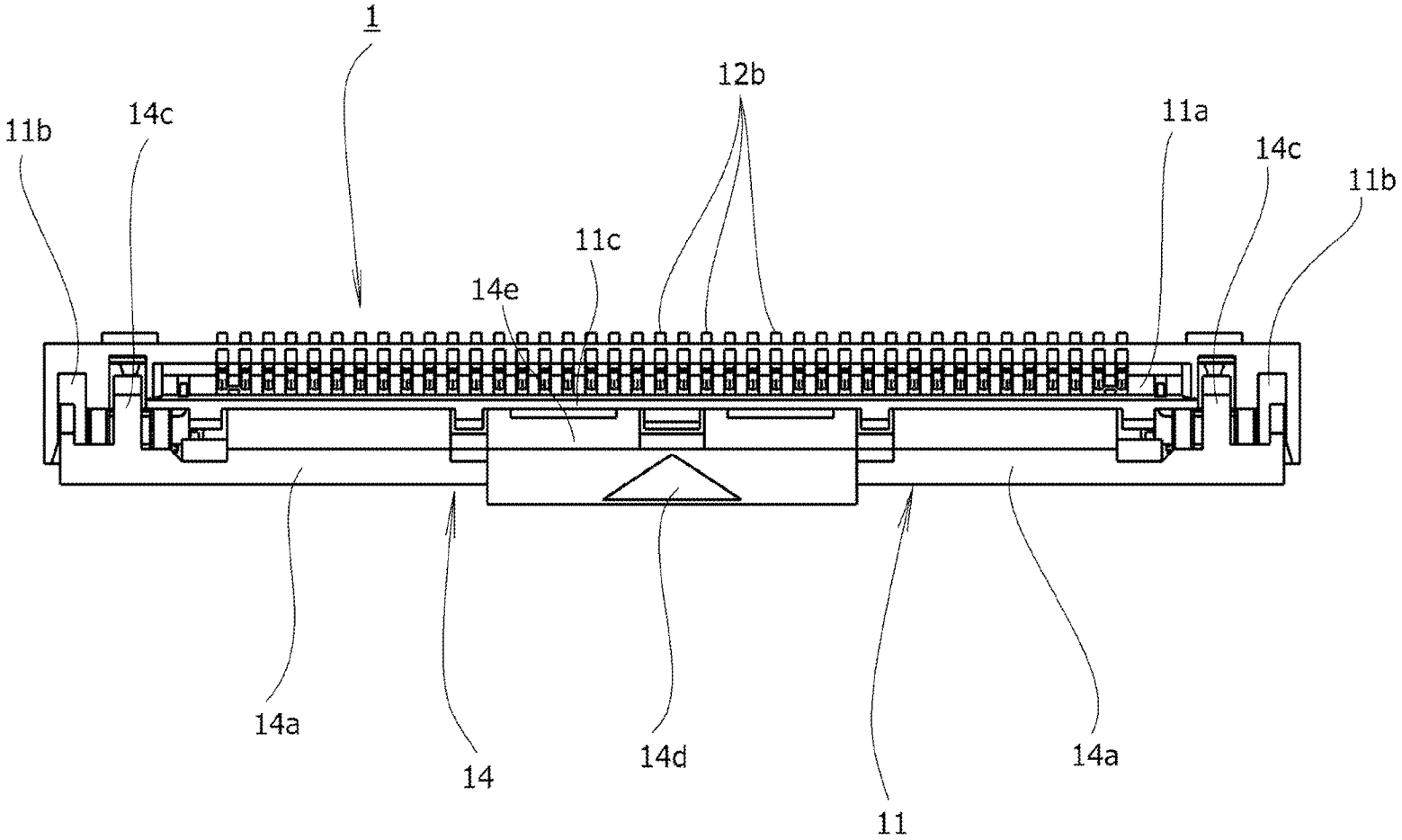
FIG. 4 is a plan view of the electric connector depicted in FIG. 1 to FIG. 3.
Figure 5:
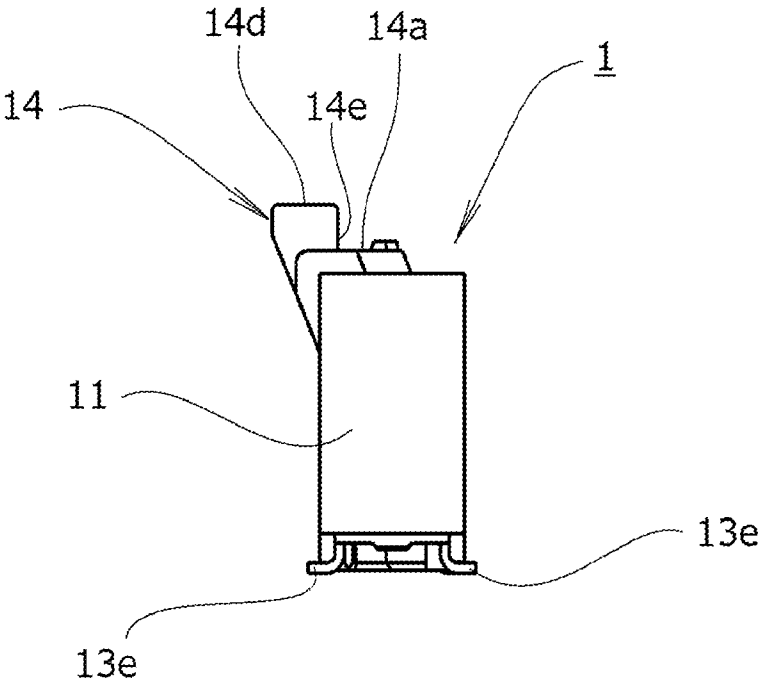
FIG. 5 is a side view of the electric connector depicted in FIG. 1 to FIG. 4.
Figure 6:
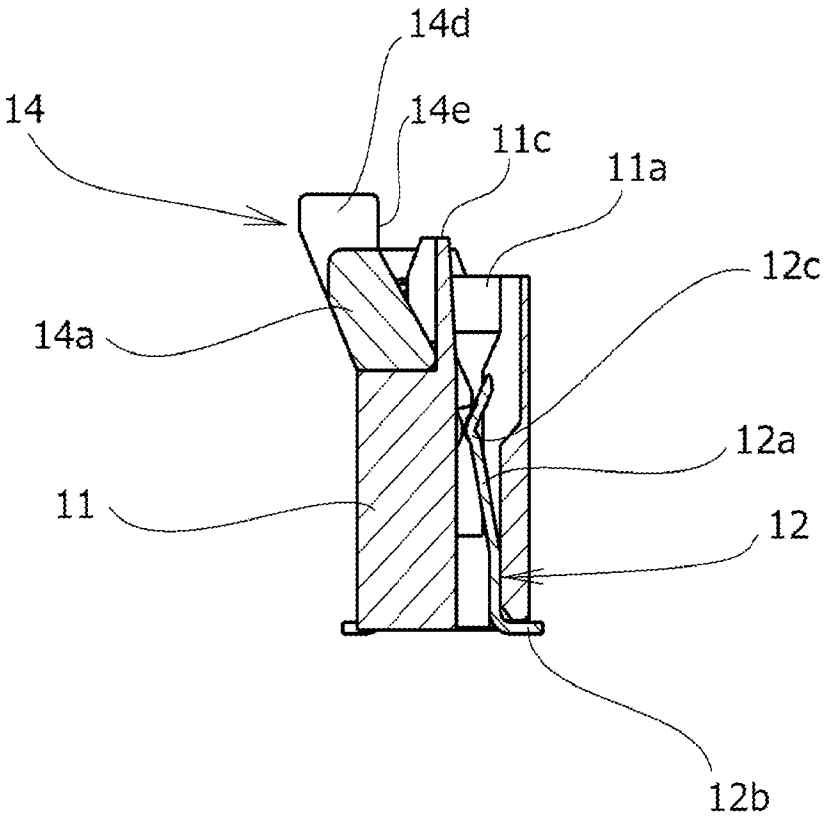
FIG. 6 is a sectional view along a VI-VI line in FIG. 3.

In the following, an electric connector according to one embodiment of the present invention is described in detail based on the drawings.

[Entire Structure of Electrical Connector]

A connector 1 according to one embodiment of the present invention depicted in FIG. 1 to FIG. 9 is an electric connector mounted by, for example, solder joint or the like, on a circuit wiring board (omitted in the drawings) configuring part of an electronic circuit provided to an electric product. The connector 1 has a housing 11 arranged so as to rise in a direction perpendicular to a main surface of the circuit wiring board substantially horizontally arranged. The housing 11 is formed of an insulating member extending in a narrow elongated shape along the main surface of the circuit wiring board.

In the following, it is assumed that the main surface of the circuit wiring board (omitted in the drawings) extends in a horizontal state and a direction in which the housing 11 rises from the surface of the circuit wiring board is taken as an "upward direction" and a direction opposite to the rising direction of the housing 11 is taken as a "downward direction". Also, it is assumed that a direction in which the housing 11 extends in the narrow elongated shape is taken as a "connector longitudinal direction" and a direction orthogonal to both of the "connector longitudinal direction" and the "upward and downward directions" is taken as a "connector width direction".

In an upper end surface of the housing 11 described above, an insertion opening 11*a* is formed so as to have a narrow elongated slit shape along the "connector longitudinal direction". Into the insertion opening 11*a*, a flat-plate-shaped signal transmission medium PB such as a flexible flat cable (FFC) or flexible printed circuit (FPC) which will be described further below is to be inserted. From the insertion opening 11*a* toward the inside and downward direction of the housing 11, a hollow medium insertion space extends to receive a terminal portion of the flat-plate-shaped signal transmission medium PB.

Also, the terminal portion of the flat-plate-shaped signal transmission medium (such as FFC or FPC) PB is moved to descend as being arranged at an upper position of the insertion opening 11*a* so as to be opposed to rise substantially orthogonally to the main surface of the circuit wiring board (omitted in the drawings). Thus, as depicted in FIG. 22 to FIG. 25, the terminal portion of the flat-plate-shaped signal transmission medium PB is inserted inside the medium insertion space of the receptacle connector 1 through the insertion opening 11*a*.

According to the above-described insertion structure of the flat-plate-shaped signal transmission medium (such as FFC or FPC) PB, when the flat-plate-shaped signal transmission medium PB is inserted inside the medium insertion space through the insertion opening 11*a* of the housing 11, a positional relation between the insertion opening 11*a* and the flat-plate-shaped signal transmission medium PB can be easily observed from above the housing 11. Thus, the flat-plate-shaped signal transmission medium PB is easily and accurately inserted, and the state after the insertion of the flat-plate-shaped signal transmission medium PB is immediately confirmed.

[Housing and Conductive Contact]

As described above, the terminal portion of the flat-plate-shaped signal transmission medium PB formed of a flexible flat cable (FFC) or a flexible printed circuit (FPC) is inserted into the medium insertion space provided in the housing 11. In that medium insertion space, as depicted particularly in FIG. 6, a plurality of conductive contacts (conductive terminals) 12 are attached in a multipolar manner with predetermined pitches along the "connector longitudinal direction". Each of these conductive contacts 12 has an elastic beam part 12*a* arranged to extend in the upward and downward directions in the medium insertion space of the housing 11. At a lower end portion of the elastic beam part 12*a*, a connection terminal part 12*b* in contact with the circuit wiring board (omitted in the drawing) is provided.

The connection terminal part 12*b* provided at the lower end portion of each conductive contact 12 extends backward (rightward in the drawing) in a substantially horizontal direction to protrude outside the housing 11. This protruding tip portion (rear end portion) is solder-jointed to a conductive path (omitted in the drawing) formed on the surface of the circuit wiring board (omitted in the drawing), thereby configuring part of a signal transmission circuit. Note that the plurality of connection terminal parts 12*b* arranged in the multipolar manner as described above can be collectively soldered.

Also, as described above, the elastic beam part 12*a* is continuously provided to an inner end side portion opposite to the solder-joint portion (outer end side portion) of each of these connection terminal parts 12*b*. The elastic beam part 12*a* extends as being curved upward from the inner end side portion of the connection terminal part 12*b* so as to have a cantilever shape. At an upper end portion of the elastic beam part 12*a* rising in the medium insertion space of the housing 11 described above, a contact part 12*c* in contact with a terminal part (omitted in the drawing) of the flat-plate-shaped signal transmission medium PB is formed so as to bulge in a convex shape.

[Signal Transmission Medium]

As described above, at the terminal portion of the flat-plate-shaped signal transmission medium (such as FFC or FPC) PB inserted inside the housing 11 as described above, the terminal parts are arranged in a multipolar manner with the predetermined pitches corresponding to the conductive contacts 12. At both end edge portions in an arrangement direction of the terminal parts in the multipolar manner, positioning parts each formed of a notched concave part are formed. Engaged with these positioning parts provided to the flat-plate-shaped signal transmission medium PB are engaging parts 13*a* of lock members 13, which will be described further below, attached to the receptacle connector 1. With the engaging operation of the lock members 13, the insertion state of the flat-plate-shaped signal transmission medium PB is maintained.

[Lock Member]

That is, at both end portions of the housing 11 in the "connector longitudinal direction" described above, as depicted in FIG. 7, the paired lock members 13, 13 each formed by bending a thin-plate-shaped metal member are attached as being inserted from below toward the inside of the housing 11. The paired theses lock members 13, 13 are attached so as to symmetrically face each other at the both side portions in the "connector longitudinal direction". With the paired lock members 13, 13 provided in this manner, the connector 1 can stably maintain the insertion state of the flat-plate-shaped signal transmission medium. Both of these lock members 13, 13 have a symmetrical relation with the same structure. Thus, in the following description, only one lock member 13 is described, and description of the other lock member 13 is omitted, with the same reference characters provided thereto.

As depicted particularly in FIG. 10 to FIG. 14, each of these lock members 13 has a base frame plate 13*b* extending in a substantially U shape in a plan view along an outer hull shape of each of the both end portions of the housing 11. On an outer end wall part (a right end wall part of FIG. 14) arranged at the outermost end position of the base frame plate 13*b* in the "connector longitudinal direction", a fixing piece 13*c* is provided so as to protrude upward. With the fixing piece 13*c* press-fitted inside the housing 11 to become in an engaged state, the entire lock member 13 becomes in a fixed state.

Also, the above-described base frame plate 13*b* has a front side wall part (a left wall part in FIG. 13) and a back side wall part (a right wall part in FIG. 13) arranged so as to be opposed to each other in the "connector width direction". Among these, the back side wall part is provided with a stopper piece 13*d* formed by cutting and raising part of the back side wall part and extending downward in a cantilever spring shape. As depicted particularly in FIG. 8, a lower end edge of the stopper piece 13*d* has an arrangement relation of making contact, from above, with a receiving surface of the housing 11 extending substantially in a horizontal direction, thereby preventing the entire lock member 13 from dropping off downward by a counterforce in the upward and downward directions by the stopper piece 13*d* with respect to the housing 11 or preventing the housing 11 together with the flat-plate-shaped signal transmission medium PB from being removed upward from the lock member 13 when the flat-plate-shaped signal transmission medium PB is removed.

Furthermore, lower end edge parts of the front side wall part (the left wall part in FIG. 13) and the back side wall part (the right wall part in FIG. 13) configuring each base frame plate 13*b* described above are provided with board connection leg parts 13*e*, 13*e* each formed of a plate-shaped member protruding substantially in the horizontal direction along the "connector width direction". Each board connection leg part 13*e* is soldered to a conductive path for grounding formed on the circuit wiring board (omitted in the drawings), thereby configuring part of a shielded (grounded) circuit and retaining the entire receptacle connector 1 on the circuit wiring board.

Figure 7:
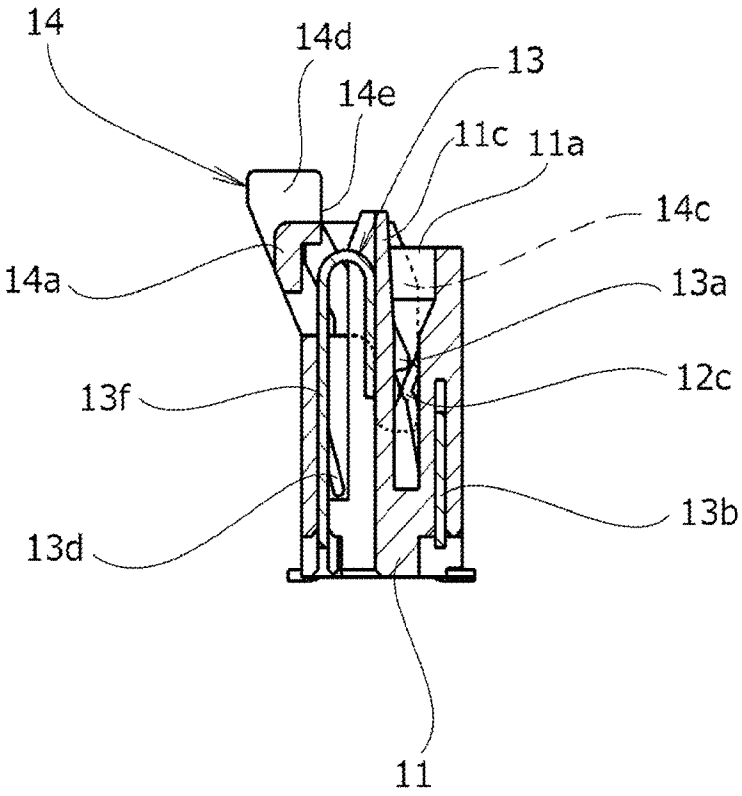
FIG. 7 is a sectional view along a VII-VII line in FIG. 3.
Figure 11:
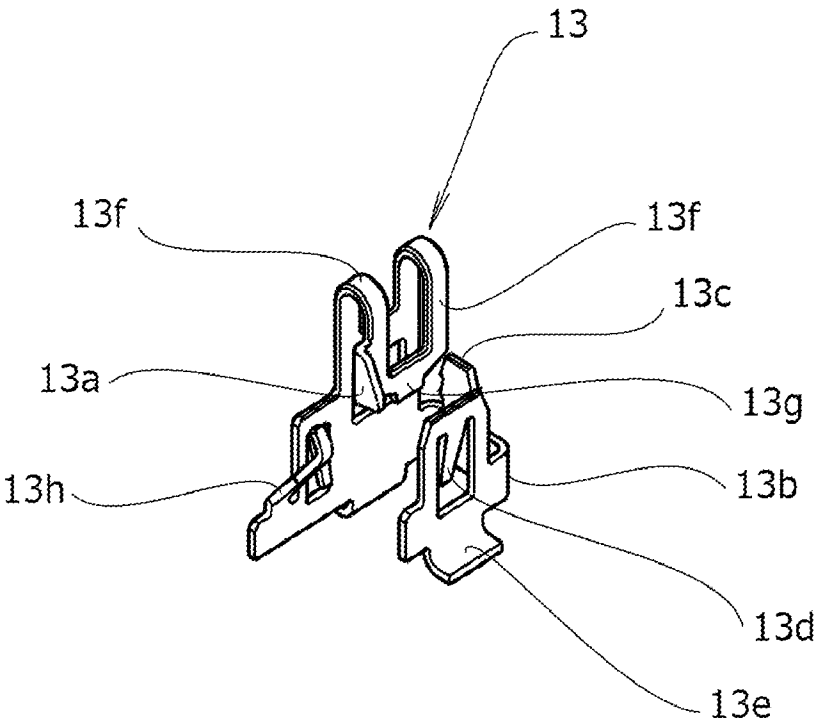
FIG. 11 is an external perspective view of the lock member depicted in FIG. 10 when viewed from above and back on an inner side of the connector (on a connector center side)
Figure 12:
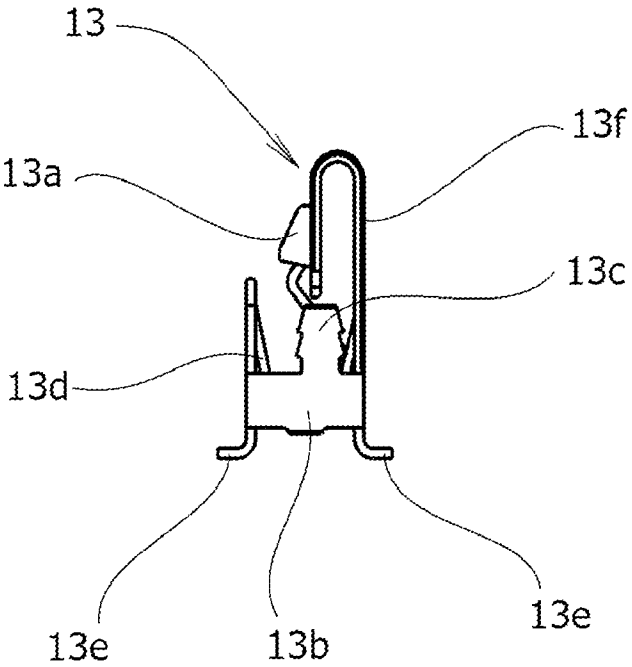
FIG. 12 is a side view of the lock member depicted in FIG. 10 and FIG. 11 when viewed from an outer side of the connector.
Figure 13:
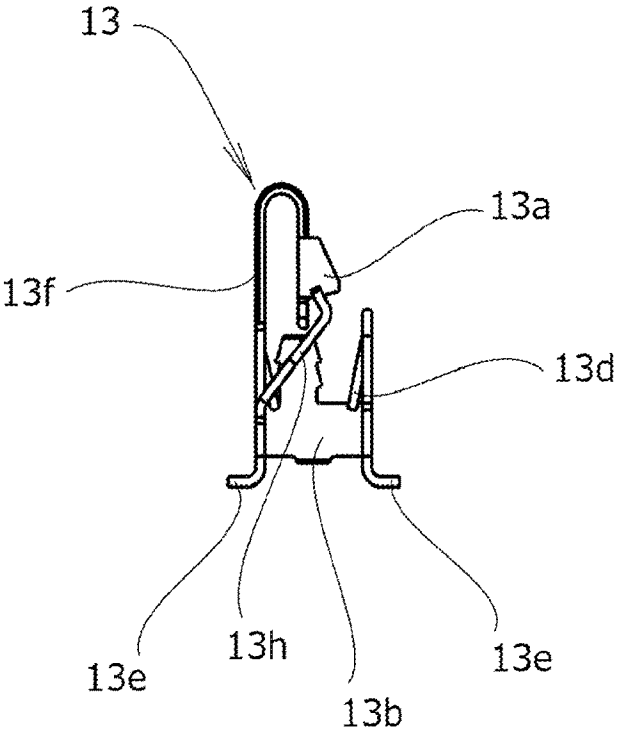
FIG. 13 is a side view of the lock member depicted in FIG. 10 to FIG. 12 when viewed from the inner side of the connector (connector center side)
Figure 14:
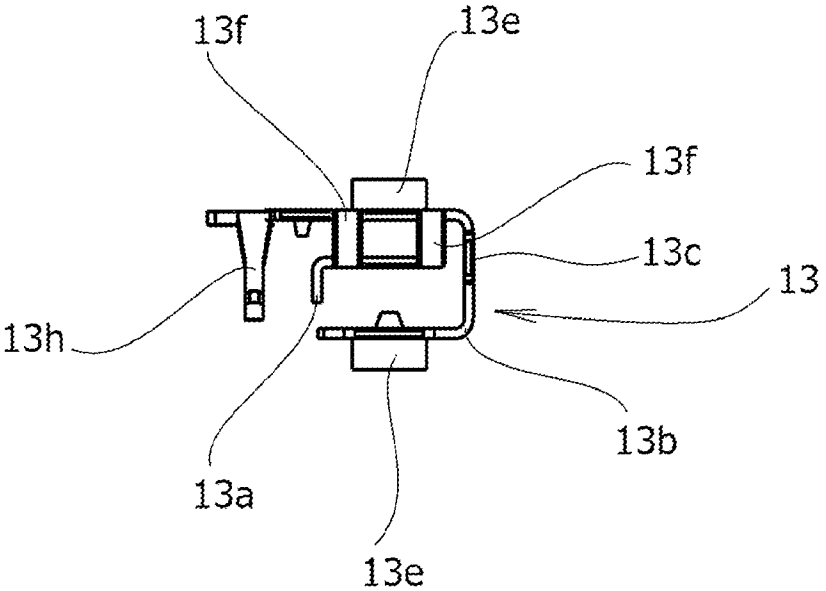
FIG. 14 is a plan view of the lock member depicted in FIG. 10 to FIG. 13.

Furthermore, an upper portion of the front side wall part (the left wall part in FIG. 13) configuring the base frame plate 13*b* described above is provided with paired lock arm members 13*f*, 13*f* each formed of an elastically-displaceable beam-shaped member as protruding upward to form a crotch shape (refer to FIG. 11). As depicted in FIG. 7, each lock arm member 13*f* extends from the upper end edge part of the front side wall part of the base frame plate 13*b* described above to a position near the above-described insertion opening 11*a*, is then bent in a curved shape so as to turn toward "the inside of the connector (the depth of the medium insertion space)", and then extends downward so as to fall from that turning portion.

Here, the turning portion configuring an upper end portion of the lock arm member 13*f* is configured so as to be swingable, and a portion extending downward in a cantilever shape from the turning portion is configured as a swing portion elastically displaceable in the "connection width direction". A lower end portion of the swing portion in the lock arm member 13*f* is provided with an engaging part 13*a* which is engaged with the positioning part of the flat-plate-shaped signal transmission medium PB described above. The lock arm member 13*f* is configured to have a crotch shape as depicted in FIG. 11 so as to be excellent in both flexibility and stiffness, which will be described in detail further below.

As described above, the lock arm member 13*f* forming the crotch shape extends downward from the above-described turning portion by a predetermined amount. At the lower end edge portions, the paired lock arm members 13*f* are integrally coupled together by an arm coupling part 13*g* extending in the "connector longitudinal direction". Of the paired lock arm members 13*f*, 13*f* integrated by the arm coupling part 13*g*, a side edge part of the lock arm member 13*f* close to the center of the connector 1 is provided with the above-described engaging part 13*a* extending to the medium insertion space.

The engaging part 13*a* is formed of a hook-shaped member substantially in a triangular shape. As depicted in FIG. 7, the engaging part 13*a* protrudes to the medium insertion space of the housing 11 so as to be bent substantially at the right angle from the side edge part of the lock arm member 13*f* as described above. A lower end edge corresponding to the base of the triangular shape configuring the outer shape of this engaging part 13*a* serves as an engaging side with respect to the positioning part of the flat-plate-shaped signal transmission medium PB described above, and is configured so that the engaging side of the engaging part 13*a* can be engaged with the inner circumferential edge part of the positioning part. Also, as depicted in FIG. 11, from the engaging side of the engaging part 13*a*, a guide side with a guiding function for the positioning part of the flat-plate-shaped signal transmission medium PB described above extends upward so as to form a tilted surface shape to decrease the amount of protrusion. After the terminal portion of the flat-plate-shaped signal transmission medium PB inserted into the medium insertion space of the housing 11 moves as making contact with and overriding the above-described guide side of the engaging part 13*a* from above, the engaging side of the engaging part 13*a* is engaged with the positioning part of the flat-plate-shaped signal transmission medium PB.

A contact-shaped member denoted by a reference character 13*h* in FIG. 10 to FIG. 14 configures a terminal member for shielding, and protrudes diagonally upward in a cantilever shape from the front side wall part (the left wall part in FIG. 13) of the base frame plate 13*b* described above toward the medium insertion space. Provided at an upper end portion of the shielding contact-shaped member 13*h* is a contact part which makes contact with a shielding electrode part (omitted in the drawing) provided to the flat-plate-shaped signal transmission medium PB.

[Lock Releasing Member]

Figure 15:
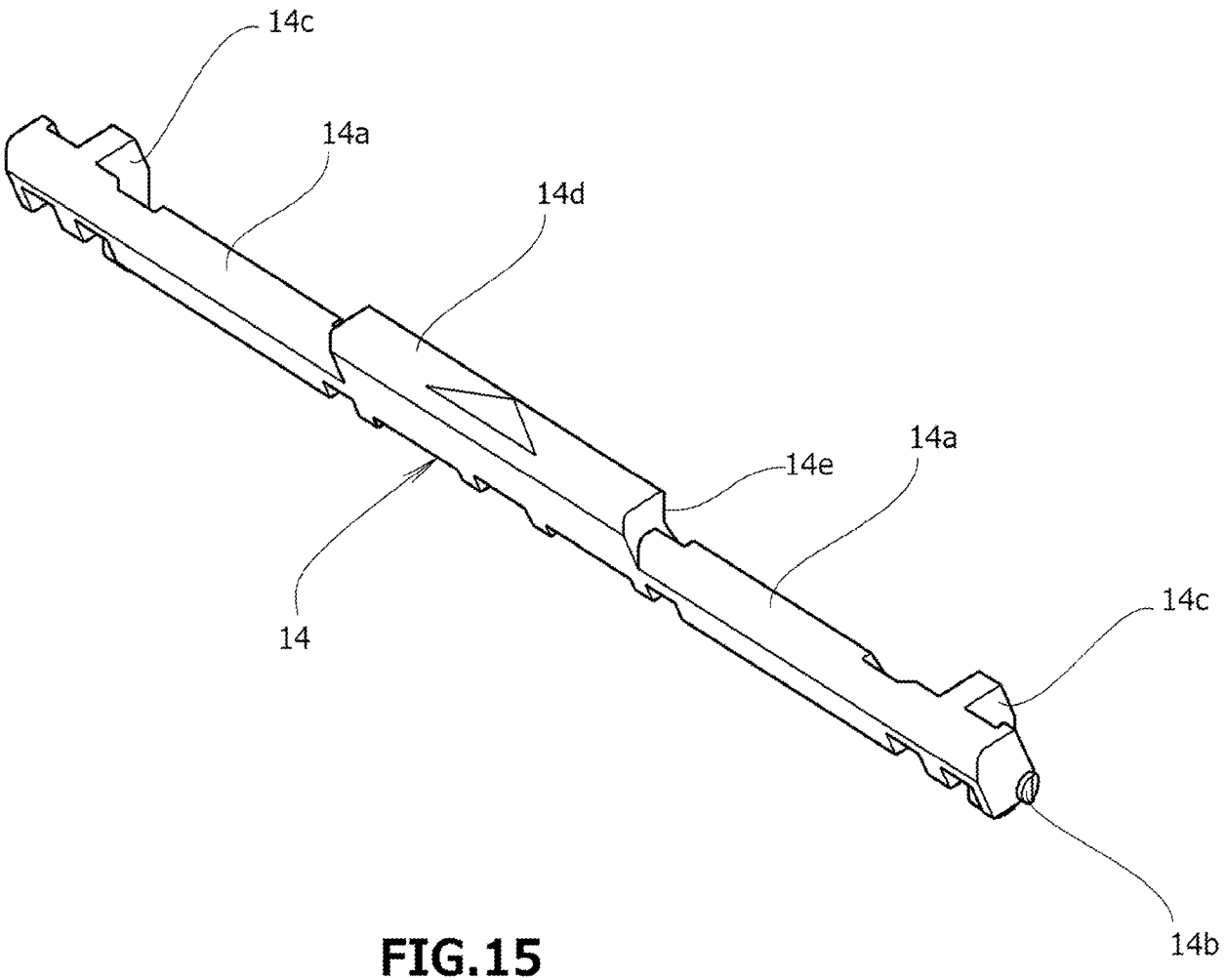
FIG. 15 is an external perspective view of a release operating part for use in the electric connector depicted in FIG. 1 to FIG. 5 when viewed from front and above.
Figure 16:
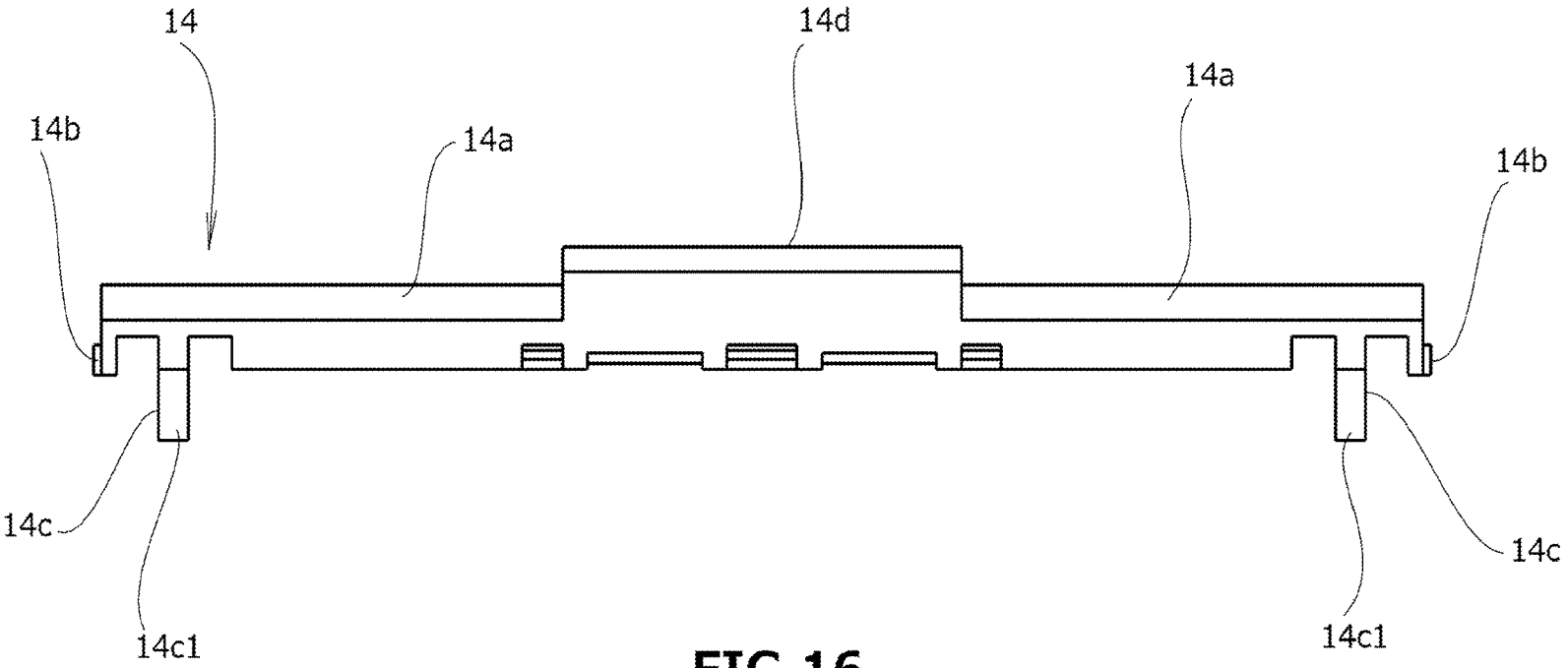
FIG. 16 is a front view of the release operating part depicted in FIG. 15.
Figure 17:
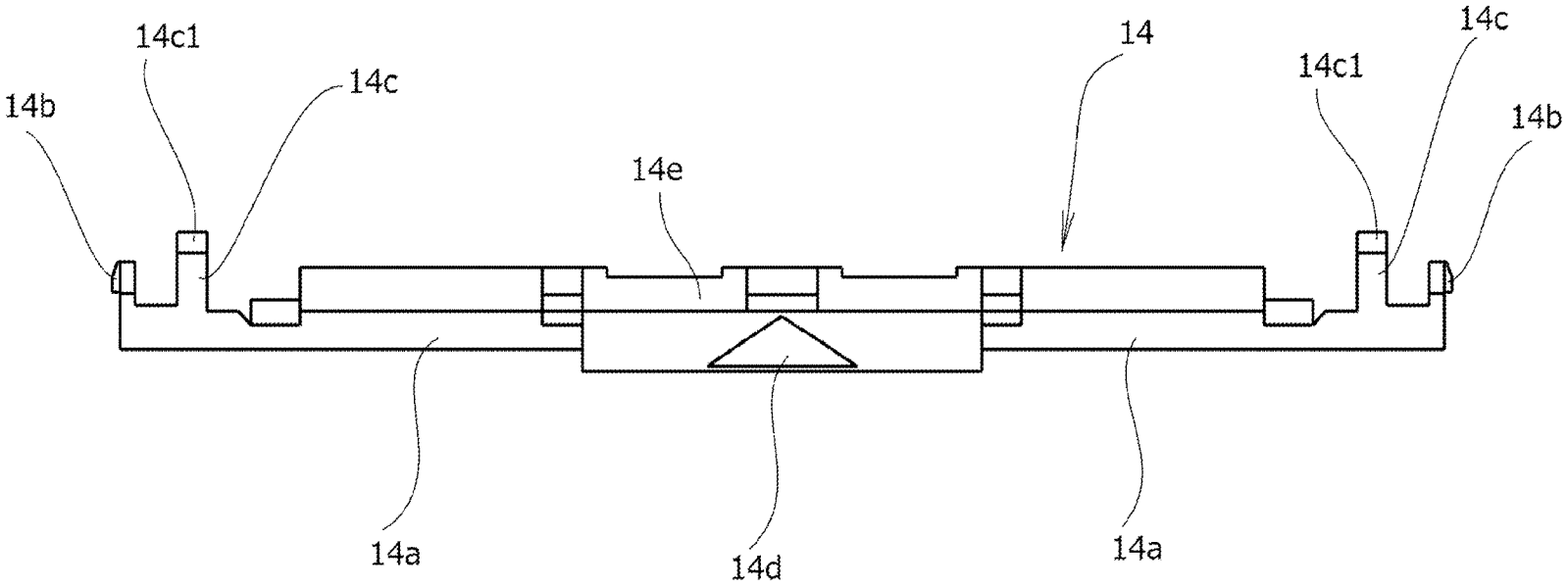
FIG. 17 is a plan view of the release operating part depicted in FIG. 15 and FIG. 16.

Annexed to the above-structured lock member 13 is a lock releasing member 14 for removing the engaging part 13*a* from the positioning part of the flat-plate-shaped signal transmission medium PB (refer to FIG. 15). This lock releasing member 14 includes a structure of operating the above-described paired lock members 13, 13 simultaneously. As depicted particularly in FIG. 15 to FIG. 18, a main body coupling part 14*a* having a substantially prism-shaped section included in the lock releasing member 14 extends in the "connector longitudinal direction" along an upper edge portion on the front of the housing 11 (a left end face in FIG. 5). At both end portions of this main body coupling part 14*a* in the "connector longitudinal direction", support shaft parts 14*b*, 14*b* are provided to protrude outward also in the "connector longitudinal direction".

Figure 8:
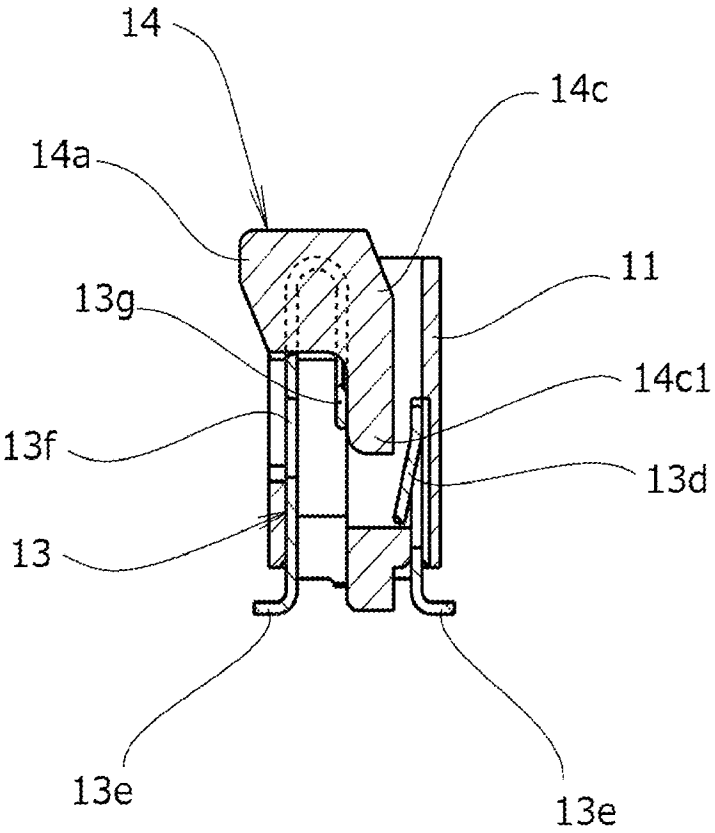
FIG. 8 is a sectional view along a VIII-VIII line in FIG. 3.
Figure 9:
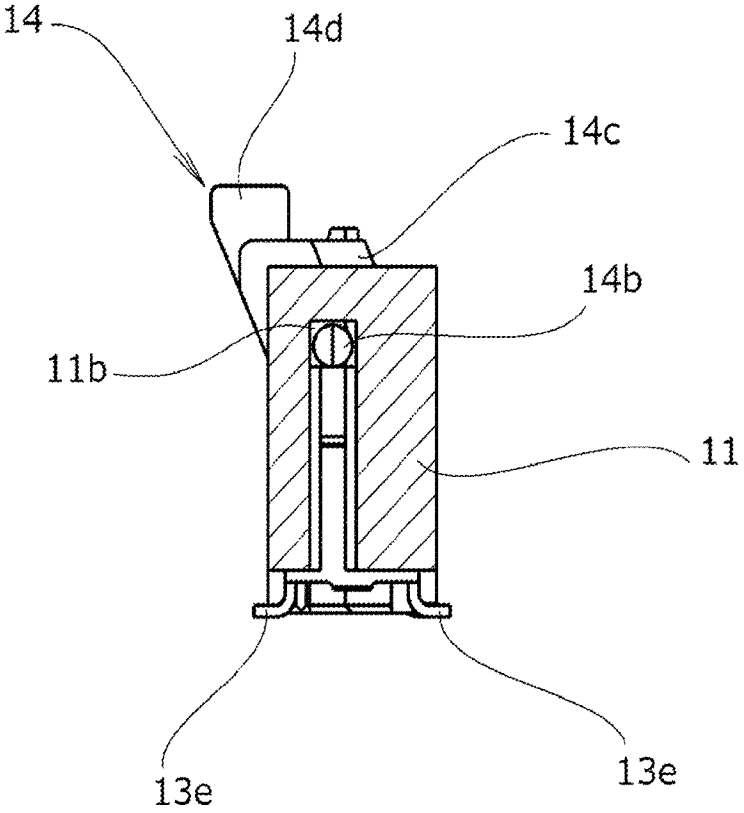
FIG. 9 is a sectional view along a IX-IX line in FIG. 3.
Figure 10:
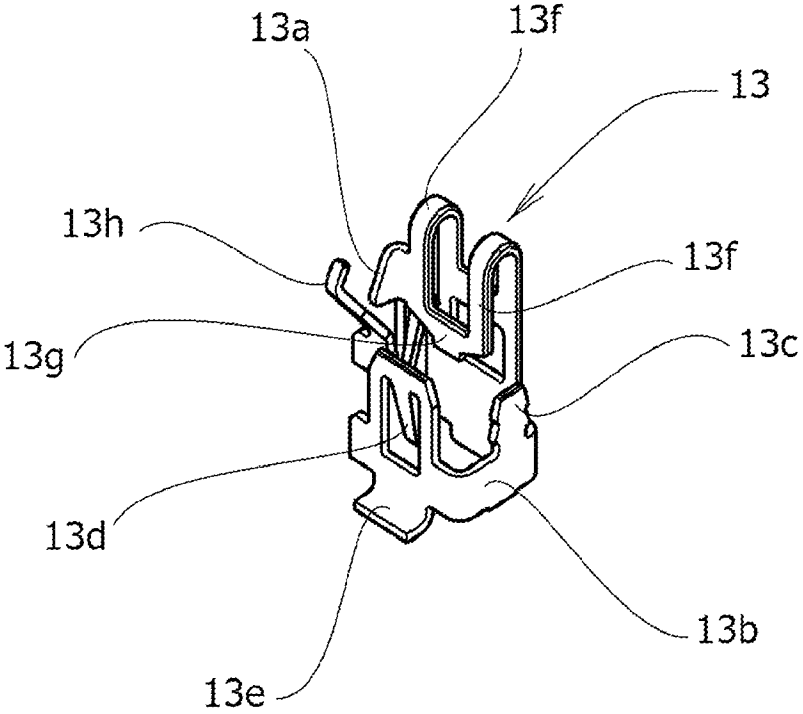
FIG. 10 is an external perspective view of a lock member for use in the electric connector depicted in FIG. 1 to FIG. 5 when viewed from above and back outside the connector.
Figure 19:
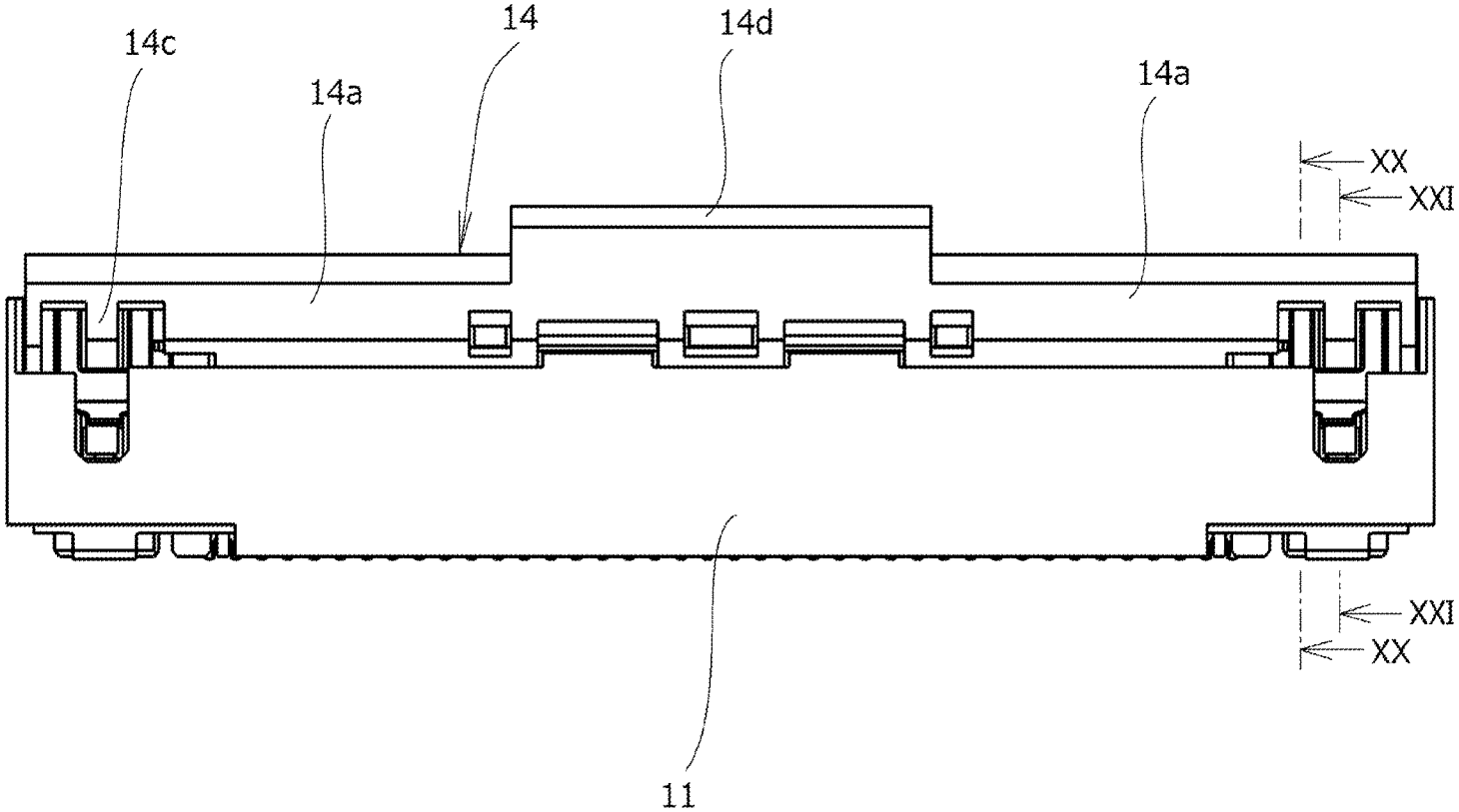
FIG. 19 is a front view of the release operating part of the electric connector depicted in FIG. 1 to FIG. 5 when rotated to an "acting position"
Figure 20:
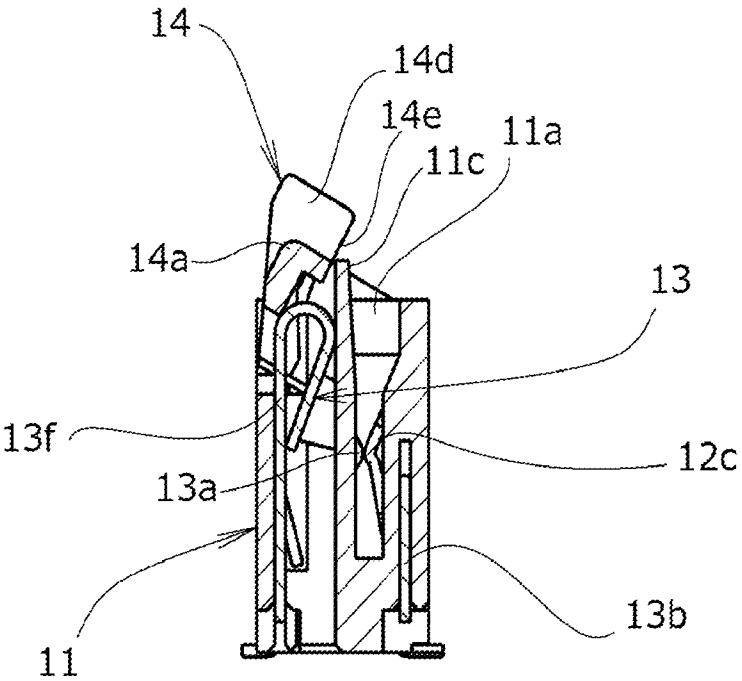
FIG. 20 is a sectional view along a XX-XX-line in FIG. 19.

These both support shaft parts 14*b*, 14*b* each have a substantially circular section and, as depicted particularly in FIG. 9, are rotatably supported in a loose-fit state inside bearing recessed parts 11*b*, 11*b* formed at the both side wall parts of the housing 11 in the "connector longitudinal direction". The entire lock releasing member 14 rotatably retained by the both support shaft parts 14*b*, 14*b* is configured to make reciprocating rotations about the support shaft parts 14*b* between an "initial position" depicted in FIG. 1 to FIG. 9 and an "acting position" depicted in FIG. 19 to FIG. 21

Also, at both end portions of the main body coupling part 14*a* described above in the "connector longitudinal direction", paired release acting parts 14*c*, 14*c* are integrally provided so as to be adjacent to each other on an inner side of the connector (a connector center side) with respect to the support shaft parts 14*b*, 14*b*. These release acting parts 14*c* and 14*c* are arranged at outermost end portions in the medium insertion space including the insertion opening 11*a* described above in the "connector longitudinal direction". These paired release acting parts 14*c* and 14*c* are linked together so as to be integrated via the main body coupling part 14*a* described above.

Figure 18:
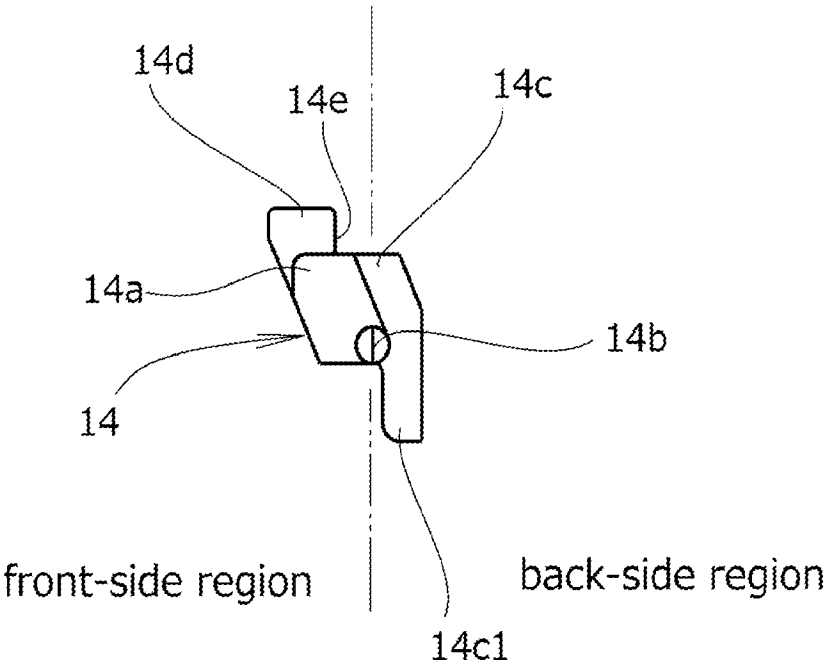
FIG. 18 is a side view of the release operating part depicted in FIG. 15 to FIG. 17.

As depicted particularly in FIG. 8 and FIG. 18, each release acting part 14*c* described above has a nail-shaped contact part 14*c*1 extending downward from the main body coupling part 14*a*. The nail-shaped contact part 14*c*1 is arranged so as to drop off downward to the medium insertion space, and has an arrangement relation so as to face the arm coupling part 13*g* of the lock member 13 described above arranged also in the medium insertion space in the "connector width direction" from the back surface side (a right side in FIG. 8). With a releasing operation force applied to a releasing operation part 14*d*, which will be described next, the release acting part 14*c* is rotated clockwise (rightward) in FIG. 8 about the support shaft part 14*b*. Thus, the nail-shaped contact part 14c1 provided to the release acting part 14c is configured to make contact with the arm coupling part 13g of the lock member 13 from the back surface side (the right side in FIG. 8).

Figure 21:
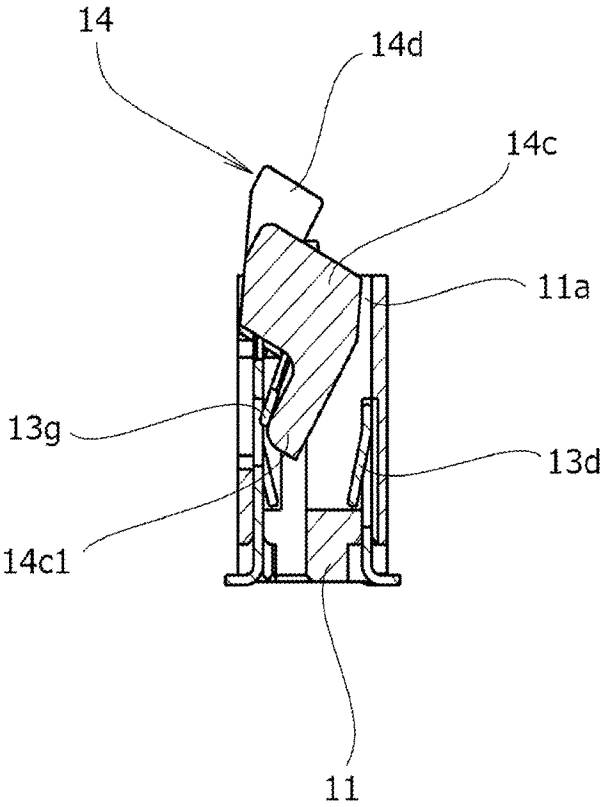
FIG. 21 is a sectional view along a XXI-XXI line in FIG. 19.
Figure 22:
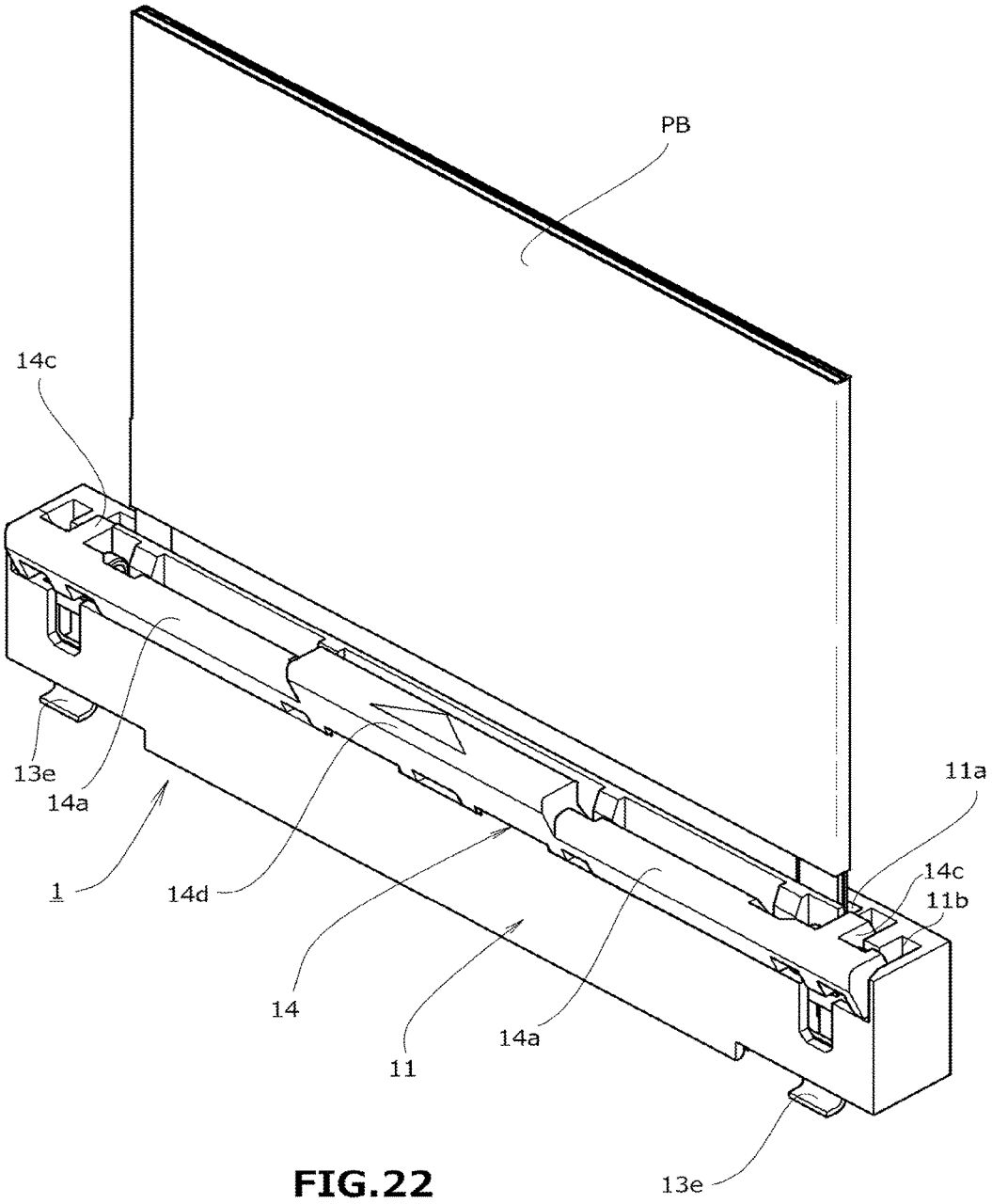
FIG. 22 is an external perspective view of the electric connector in the initial state depicted in FIG. 1 to FIG. 5 with a flat-plate-shaped signal transmission medium (such as an FFC or FPC) inserted thereinto.
Figure 23:
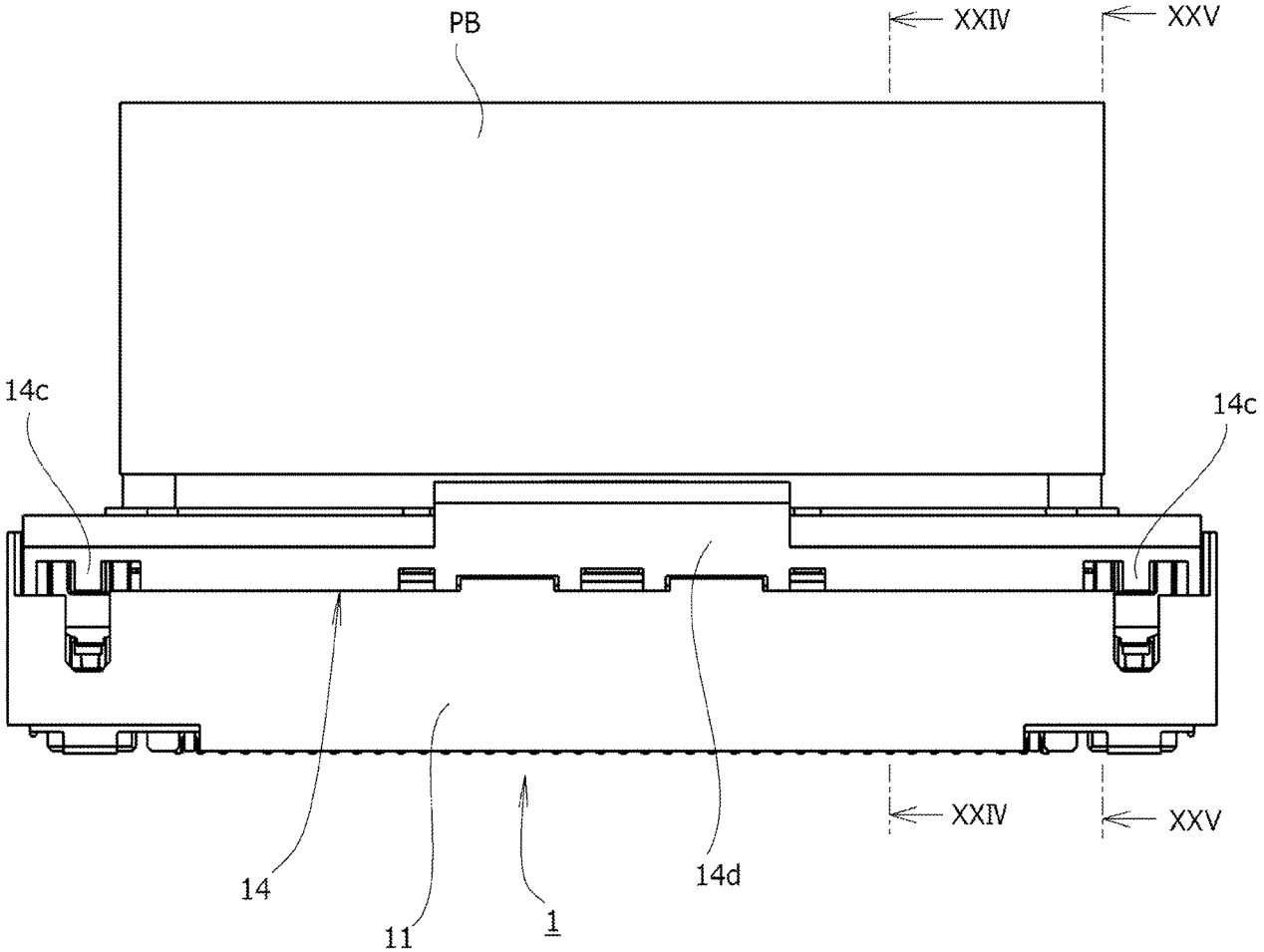
FIG. 23 is a front view of the electric connector depicted in FIG. 22 with the flat-plate-shaped signal transmission medium (such as an FFC or FPC) inserted thereinto.
Figure 24:
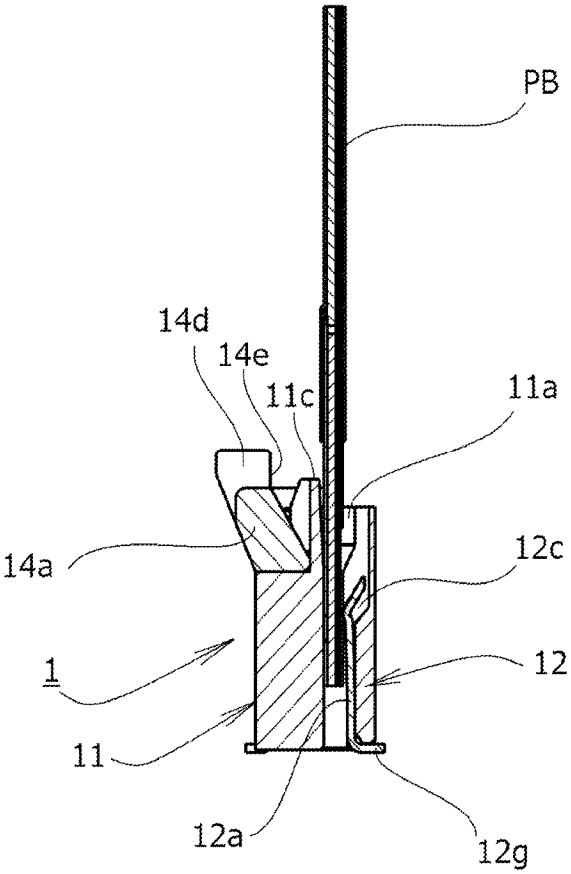
FIG. 24 is a sectional view along a XXIV-XXIV line in FIG. 23.
Figure 25:
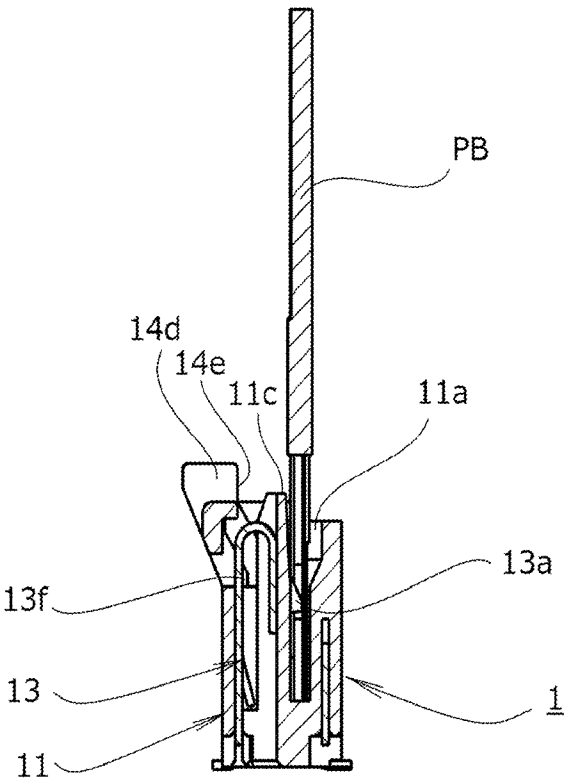
FIG. 25 is a sectional view along a XXV-XXV line in FIG. 22.

Then, after the nail-shaped contact part 14c1 of the release acting part 14c makes contact with the arm coupling part 13g of the lock member 13, the releasing operation by the releasing operation part 14d, which will be described further below, further continues. Thus, as depicted in FIG. 21, the nail-shaped contact part 14c1 of the release acting part 14c presses the arm coupling part 13g of the lock member 13 toward the front (leftward in FIG. 21), thereby elastically displacing the lock member 13 and displacing the engaging part 13a toward the front (leftward in FIG. 21).

On the other hand, as depicted in FIG. 15, the releasing operation part 14d forming a block shape is integrally provided at a substantially center portion of the main coupling part 14a of the lock releasing member 14 described above in the "connector longitudinal direction". The release operating part 14d extends over a length approximately ⅓ of the main coupling part 14a in the "connector longitudinal direction", and is provided so as to protrude upward from the upper surface of the main body coupling part 14a. The release operating part 14d may be provided to the entire main body coupling part 14a in the "connector longitudinal direction".

As depicted in FIG. 18, the release operating part 14d described above is arranged in a region opposite to each release acting part 14c described above in a radius direction of rotation about the support shaft part 14b. These release operating part 14d and release acting part 14c have an arrangement relation so as to be opposed to each other across the support shaft part 14b. More specifically, the release operating part 14d is arranged in a region above the support shaft part 14b described above and on a front side (left side in FIG. 18) in the connector width direction, and is configured to make reciprocating rotations about the support shaft part 14b between the "initial position" (refer to FIG. 5 to FIG. 7) away from the insertion opening 11a and the "acting position" (refer to FIG. 19 to FIG. 21) near the insertion opening 11a.

Here, the release operating part 14d described above has an outer side wall surface which, for example, a finger tip of an operator may touch, and an inner side wall surface opposite to the outer side wall surface and facing the insertion opening 11a described above. On the inner side wall surface of the release operating part 14d, a positioning part 14e which regulates a rotation range of the release operating part 14d is formed. For example, when the release operating part 14d is at the "initial position" as in FIG. 7, the positioning part 14e is maintained as being away from an inner opening wall part 11c of the housing 11 forming the insertion opening 11a to the front side. As depicted particularly in FIG. 20, when the release operating part 14d is rotated to the "acting position", the positioning part 14e of the release operating part 14d makes contact with the inner opening wall part 11c of the housing 11 described above from the front side to regulate rotating operation of the release operating part 14d onward.

By providing the positioning part 14e which regulates the rotation range when the release operating part 14d is operated, excessive rotating operation of the lock release member 14 is regulated by the inner opening wall part 11c of the housing 11, thereby achieving operations and effects such as avoiding plastic deformation of the lock member 13 and preventing damages on each part configuring the connector.

When the release operating part 14d of the lock releasing member 14 moves so as to rotate about the support shaft part 14b, the release operating part 14d comes close to the flat-plate-shaped signal transmission medium PB inserted into the medium insertion space of the housing 11. On the other hand, the nail-shaped contact part 14c1 of the release acting part 14c arranged in the region (a back-side region depicted in FIG. 18) opposite to the release operating part 14d across the support shaft part 14b goes away from the flat-plate-shaped signal transmission medium PB inserted into the medium insertion space of the housing 11.

More specifically, firstly, when the release operating part 14d is at the "initial position" away from the insertion opening part 11a, as depicted in FIG. 8, the nail-shaped contact part 14c1 of the release acting part 14c is arranged as being away from the arm coupling part 13g of the lock member 13, that is, in a state in which the lock arm member 13f is not elastically displaced without the nail-shaped contact part 14c1 pressing the arm coupling part 13g. In this manner, in the state in which the release operating part 14d is at the "initial position", as depicted in FIG. 22 to FIG. 25, when the terminal portion of the flat-plate-shaped signal transmission medium (such as FFC or FPC) PB is inserted into the medium insertion space, the engaging part 13a of the lock member 13 causes the flat-plate-shaped signal transmission medium PB to become in a locked state.

Furthermore, from the lock state of the flat-plate-shaped signal transmission medium (such as FFC or FPC) PB described above, as depicted in FIG. 26 and FIG. 27, when the release operating part 14d is rotated to the "acting position" so as to come close to the insertion opening 11a, the nail-shaped contact part 14c1 of the release acting part 14c makes contact with the arm coupling part 13g of the lock member 13 to become in a pressed state, as depicted in FIG. 21. This elastically displaces the lock arm member 13f toward the front as depicted in FIG. 27, causing the engaging part 13a in an engaged state with respect to the positioning part of the flat-plate-shaped signal transmission medium PB so far to make a transition to a state of going away from the flat-plate-shaped signal transmission medium PB to be released, thereby allowing removal of the flat-plate-shaped signal transmission medium PB.

Here, the reason why the lock arm member 13f is configured to have a crotch shape as described above as depicted in FIG. 10 is that the nail-shaped contact part 14c1 of the release acting part 14c is easily misaligned with respect to the engaging part 13a in a plate width direction of the lock arm member 13f (connector longitudinal direction). That is, if the base end portion on the upper end side of the lock arm member 13f has not a crotch shape but an integrally-continuous shape, the stiffness of the integrally-continuous portion becomes too large to sufficiently achieve flexibility of the lock arm member 13f. Also, if the plate width dimension of the integrally-continuous base end portion on the upper end side is reduced to ensure flexibility of the lock arm member 13f, a problem arises in view of torsional stiffness. That is, if the position of the nail-shaped contact part 14c1 of the release acting part 14c is shifted with respect to the engaging part 13a in the plate width direction (connector longitudinal direction), plastic deformation in a torsional direction may occur to the lock arm member 13f by a force applied to the engaging part 13a when the flat-plate-shaped signal transmission medium PB is inserted or when the flat-plate-shaped signal transmission medium PB retained after insertion is forcibly pulled out. Therefore, as in the present embodiment, if the base end portion on the upper end side (lower turning portion) of the lock arm member 13*f* has the crotch structure, the flexibility of the lock arm member 13*f* can be favorably maintained, and the stiffness required to the load to the engaging part 13*a* can also be achieved.

Figure 26:
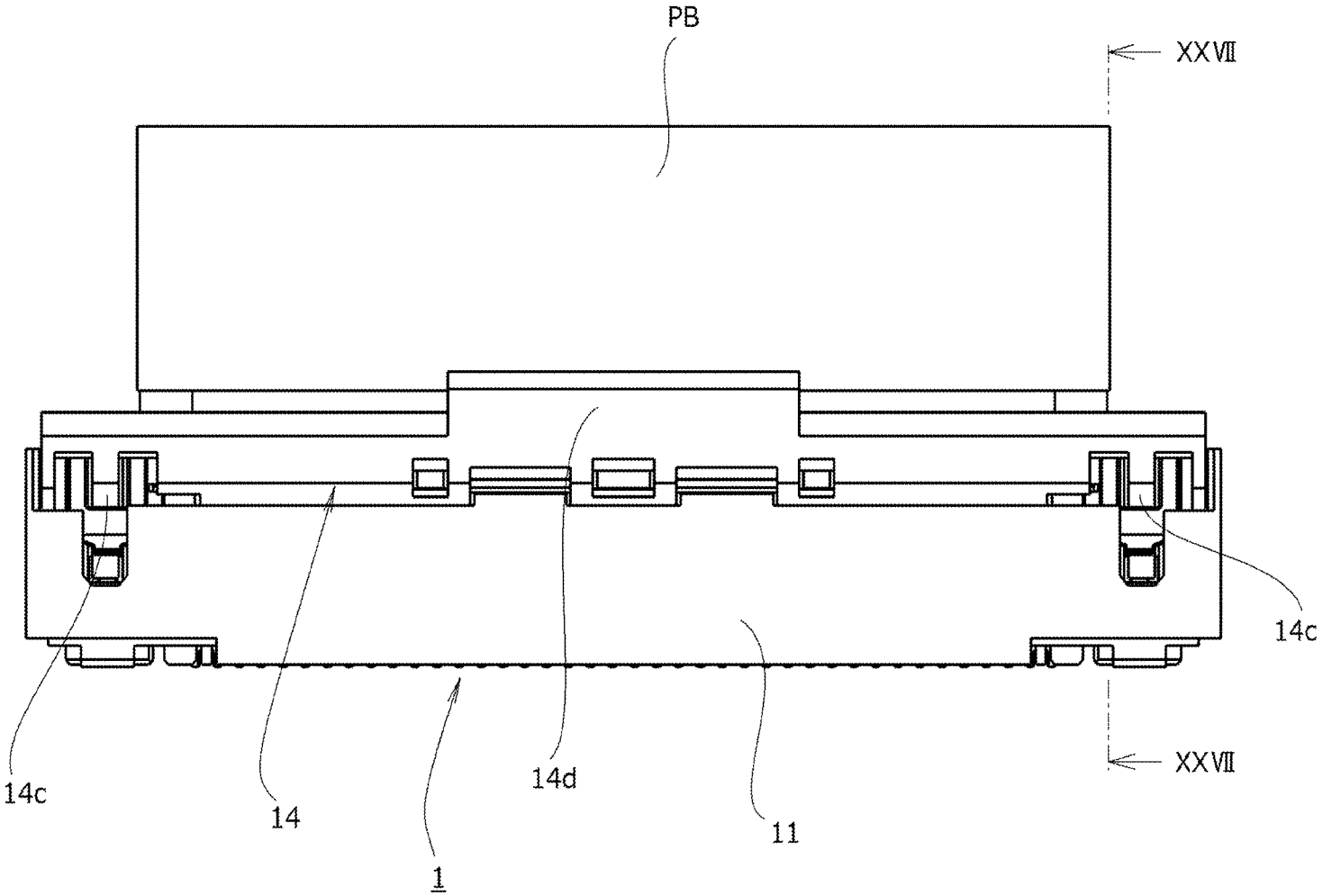
FIG. 26 is a front view of the release operating part of the electric connector depicted in FIG. 23 with the flat-plate-shaped signal transmission medium (such as an FFC or FPC) inserted thereinto when rotated to the "acting position"
Figure 27:
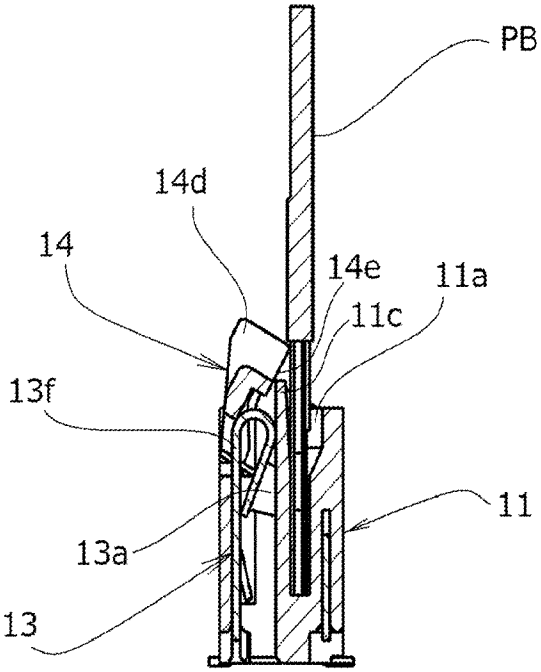
FIG. 27 is a sectional view along a XXVII-XXVII line in FIG. 26.

According to the present embodiment with the above-described structure, as depicted in FIG. 22 to FIG. 25, when the flat-plate-shaped signal transmission medium PB inserted inside from the insertion opening 11*a* of the housing 11 to be engaged is removed, for example, while a finger tip of the operator is pressed onto the release operating part 14*d* of the lock releasing member 14, the releasing operating part 14*d* is rotated to the "acting position" as depicted in FIG. 26 and FIG. 27. This moves the releasing operating part 14*d* of the lock releasing member 14 to become in a state of coming close to the main surface of the flat-plate-shaped signal transmission medium PB inserted into the insertion opening 11*a*. As a result, as described above, the finger tip of the operator pressed onto the release operating part 14*d* of the lock releasing member 14 makes contact also with the main surface of the flat-plate-shaped signal transmission medium PB. Thus, the operator can hold the flat-plate-shaped signal transmission medium PB while releasing the engaged state of the lock member 14 with respect to the flat-plate-shaped signal transmission medium PB, and thus can remove the flat-plate-shaped signal transmission medium PB with operation only by one hand.

Also, in the present embodiment, when the lock releasing member 14 is at the "initial position", with the insertion opening 11*a* extending in the narrow elongated shape over the housing 11 as a boundary, the release operating part 14*d* of the lock releasing member 14 and the engaging part 13*a* of the lock member 13 are arranged in a one-side region in the opening width direction (connector width direction) orthogonal to the extending direction of the insertion opening 11*a*, thereby reducing the thickness and size of the connector 1.

As has been described in the foregoing, while the invention made by the inventor has been specifically described based on the embodiment, it goes without saying that the present invention is not limited to the embodiment described above and can be variously modified in a range not deviating from the gist of the present invention.

For example, while the paired lock members 13 are provided to the housing 11 in the present embodiment, this is not meant to be restrictive. The number of lock members 13 to be provided to the housing 11 may be one or three or more.

Also, the present invention is not limited to a vertical-insertion-type electric connector in which a flat-plate-shaped signal transmission medium is inserted into a circuit wiring board from a vertical direction, and can also be similarly applied to a horizontal-insertion-type electric connector in which a flat-plate-shaped signal transmission medium is inserted into a circuit wiring board from a horizontal direction.

Furthermore, the electric connector according to the present invention is not limited to one for connection of a flat-plate-shaped signal transmission medium as described in the embodiment described shove. The present invention can also be similarly applied to any of electric connectors of various types for electrically connecting a board and a board, or a cable and a board.

As has been described above, the present invention can be widely applied to electric connectors of various types for use in electrical appliances.

What is claimed is:

1. An electric connector to be mounted on a circuit wiring board for use, comprising:

an insulating housing inside which a terminal portion of a flat-plate-shaped signal transmission medium is inserted through an insertion opening provided as extending in a narrow elongated shape;

a lock member which retains the flat-plate-shaped signal transmission medium by an engaging part becoming in an engaged state with respect to the flat-plate-shaped signal transmission medium inserted inside the housing;

a conductive contact member to be attached to the housing and electrically connected to the flat-plate-shaped signal transmission medium retained by the lock member; and a lock releasing member having a release operating part attached to the housing as being in a state of making reciprocating rotations about a support shaft part extending along an extending direction of the insertion opening and a release acting part which operates in an interlocked manner with the rotation of the release operating part, with the release operating part of the lock releasing member rotated from an initial position to an acting position, the release acting part making contact with the lock member and the engaging part of the lock member in the engaged state making a transition to a released state, wherein the release operating part provided to the lock release member is arranged as extending along the extending direction of the insertion opening, the release operating part and the release acting part of the lock releasing member are arranged so as to be opposed to each other across the support shaft part in a radius direction of rotation about the support shaft part, and the release operating part of the lock releasing member is positioned away from the insertion opening at the initial position and is positioned close to the insertion opening at the acting position.

2. The electric connector according to claim 1, wherein the lock member is arranged on each of both side portions of the insertion opening to form a pair in the extending direction of the insertion opening.

3. The electric connector according to claim 1, wherein the lock releasing member is provided with a positioning part which makes contact with the housing when the release operating part is rotated to the acting position.

4. The electric connector according to claim 1, wherein when the release operating part of the lock releasing member is rotated from the initial position to the acting position, the release acting part is positioned away from the insertion opening.

* * * * *